US011008141B2

(12) United States Patent
Savenok

(10) Patent No.: US 11,008,141 B2
(45) Date of Patent: May 18, 2021

(54) LIQUID CONTAINER LID ASSEMBLY FOR CONTROLLED LIQUID DELIVERY

(71) Applicant: Pavel Savenok, Wheaton, IL (US)

(72) Inventor: Pavel Savenok, Wheaton, IL (US)

( * ) Notice: Subject to any disclaimer, the term of this patent is extended or adjusted under 35 U.S.C. 154(b) by 15 days.

(21) Appl. No.: 16/300,695

(22) PCT Filed: May 18, 2017

(86) PCT No.: PCT/US2017/033389

§ 371 (c)(1),
(2) Date: Nov. 12, 2018

(87) PCT Pub. No.: WO2017/201321

PCT Pub. Date: Nov. 23, 2017

(65) Prior Publication Data

US 2019/0283940 A1 Sep. 19, 2019

Related U.S. Application Data

(60) Provisional application No. 62/338,503, filed on May 18, 2016.

(51) Int. Cl.
*B65D 47/04* (2006.01)
*B65D 47/26* (2006.01)
(Continued)

(52) U.S. Cl.
CPC ..... *B65D 47/265* (2013.01); *B65D 43/00* (2013.01); *B65D 43/02* (2013.01); *B65D 43/0208* (2013.01); *B65D 51/18* (2013.01); *B65D 2543/00046* (2013.01); *B65D 2543/00092* (2013.01); *B65D 2543/00296* (2013.01); *B65D 2543/00509* (2013.01);
(Continued)

(58) Field of Classification Search
CPC .... B65D 43/00; B65D 43/02; B65D 43/0208; B65D 47/265; B65D 51/18; B65D 2543/00046; B65D 51/00092; B65D 2543/00296; B65D 2543/00509; B65D 2543/00537; B65D 2543/00555; B65D 2543/00731; B65D 2543/00796
USPC ..... 220/711, 367.1
See application file for complete search history.

(56) References Cited

U.S. PATENT DOCUMENTS

2003/0089713 A1* 5/2003 Belt ..... B65D 47/265 220/253

* cited by examiner

*Primary Examiner* — James N Smalley
*Assistant Examiner* — Elizabeth J Volz
(74) *Attorney, Agent, or Firm* — Christopher J. Scott

(57) ABSTRACT

A liquid container lid assembly enables a user to more effectively control liquid egression from a liquid container as outfitted with the lid assembly. The lid assembly includes a lower lid construction and an upper lid construction. The lower lid construction includes an upper-receiving depression having at least one liquid-letting aperture. The lower lid construction is removably attachable to an upper container rim of a liquid container and the upper-receiving depression includes concave upper portion surfacing. The upper lid construction is nestable in superior adjacency to the upper-receiving depression and includes a lower-opposing portion and a primary liquid outlet. The lower-opposing portion includes convex lower portion surfacing, which convex lower portion surfacing mimics the concave upper portion surfacing for eliminating gaps therebetween. The primary liquid outlet is orientable in superior adjacency to the lower lid construction for selectively outletting liquid received in an assembly-outfitted liquid container.

20 Claims, 26 Drawing Sheets

(51) Int. Cl.

| | |
|---|---|
| ***B65D 43/02*** | (2006.01) |
| ***B65D 51/18*** | (2006.01) |
| ***B65D 43/00*** | (2006.01) |

(52) U.S. Cl.

CPC ..... *B65D 2543/00537* (2013.01); *B65D 2543/00555* (2013.01); *B65D 2543/00731* (2013.01); *B65D 2543/00796* (2013.01)

211
28
33
17

211
28
17
22
14
32
16
41
13
22
40
32

211
17
33
28 a
b
c
43
44
47
47
44
47
46
45
46
47
46 a
b
c
28
48
48
28
29
28
28
29
49
49

211

LIQUID CONTAINER LID ASSEMBLY FOR CONTROLLED LIQUID DELIVERY

PRIOR HISTORY

This application is a US National Stage Application under 35 USC § 371 from International Patent Application No. PCT/US2017/033389, which application was filed in the United States Patent and Trademark Office (USPTO) as the International Receiving Office on 18 May 2017 and claimed the benefit of or priority to U.S. Provisional Patent Application No. 62/338,503 filed in the USPTO on 18 May 2016.

FIELD OF THE INVENTION

The present invention relates generally to liquid container lid assembly for outfitting hot liquid or hot consumable containers. More particularly, the present invention relates to container lid assemblies for outfitting a hot consumable liquid containers for enabling enhanced control of liquid delivery via compartmentalization and heat transfer from lid-diverted or compartmentalized liquid prior to liquid egression.

BRIEF DESCRIPTION OF THE PRIOR ART

The broad field of lids for hot beverage or liquid consumable containers and hot beverage or consumable container assemblies inclusive of lids is exceedingly well-developed. The art relating to means for cooling hot beverages prior to consumption by way of a lid construction or assembly is a bit more limited. It is difficult to pinpoint with precision the most pertinent art relevant to the present invention given the wide swath of art swept by beverage container constructions and developments in the field of art generally. Nevertheless, some of the more pertinent prior is believed to be briefly described hereinafter.

U.S. Pat. No. 5,873,493 ('493 patent), issued to Robinson, for example, discloses an Integrally Molded Measurer Dispenser. The '493 patent describes a closure providing a side wall having first and second distal ends, an inner surface and an outer perimeter. A cone-shaped divider projects inwardly and upwardly from a lower perimeter of the side wall and includes a drain-back orifice therethrough. The cone-shaped divider further includes an apex having an opening therethrough. The closure further provides a lid pivotally attached at an outer diameter thereof to the outer perimeter of the side wall first distal end by an integral hinge. The lid includes a shaped substantially conforming to the side wall perimeter.

U.S. Pat. No. 6,176,390 ('390 patent), issued to Kemp, discloses a Container Lid with Cooling Reservoir. The '390 patent describes a container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

U.S. Pat. No. 6,488,173 ('173 patent), issued to Milan, discloses a Beverage container lid having baffle arrangement for liquid cooling. The '173 patent describes a removable beverage container lid wherein the lid has a substantially enclosed space defined between an exterior cover and an interior cover. At least one inlet opening is formed in the interior cover directing a hot beverage to flow into the substantially enclosed space.

Attached to the interior cover at the forward edge of the inlet opening is a partition or wall assembly having a height extending to be located substantially against the exterior cover and a length at least equal to the length of the inlet aperture. Between the partition or wall assembly and the peripheral edge of the exterior cover is located a gap area. Connected with the gap area is a dispensing opening formed in the exterior cover. Hot beverage is required to flow around the partition or wall assembly and into the gap area prior to flowing through the dispensing opening exteriorly of a beverage container.

U.S. Pat. No. 6,732,875 ('875 patent), issued to Smith et al., discloses a Reclosable Container Lid. The '875 patent describes a reclosable lid for a beverage container comprising a first piece or cover, and a movable second piece or disk. The cover has a top wall, a side wall and a mounting portion for connecting the lid on the container. The cover has an opening adapted to permit the flow of the substance through the lid. The cover further includes a slot located in the top wall. The disk has at least one aperture, a post, and a projection.

The aperture and the projection are each cooperatively dimensioned with the opening. The post is adapted to be received by the slot in the cover. The disk is movable between a first position wherein at least a portion of the projection is received in the opening in the first position, and a second position wherein the aperture is aligned with the opening in the second position. A support ledge and a support edge on an inner surface of the cover are adapted to provide rotatable support to the disk.

U.S. Pat. No. 7,448,510 ('510 patent), issued to Pavlopoulos, discloses a Cup Assembly having a Cooling Compartment. The '510 patent describes a cup assembly comprising a cup and a lid to define therebetween a first passage and a second passage to allow a liquid cooling compartment between the lid and the cup to be filled with liquid contained in the cup when the first passage is clear and the second passage is blocked and the liquid in the liquid cooling compartment is able to flow out of an outlet in communication with the liquid cooling compartment when the second passage is clear and the first passage is blocked.

U.S. Pat. No. 8,528,768 ('768 patent), issued to D'Amato, discloses a Reclosable Lid for a Container. The '768 patent describes a lid for a paper cup type container. The lid is detachably mountable onto the edge of an opening of the container. The lid comprises a lower lid part with an inner outlet opening, and an upper lid part with an outer outlet opening. In an assembled position, the upper lid part is mounted rotatable relative to the lower lid part between at least two positions, such that the outlet openings are mutually aligned in one position and are without any overlap in the other position. The lower lid part has a circumferential mounting flange for overlapping the opening edge of the container, and the upper lid part has a circumferential mounting flange for overlapping the mounting flange of the lower lid part.

U.S. Patent Application Publication No. 2007/0062943, authored by Bosworth, Sr., describes a container lid for a cup-type beverage which includes within the lid a disc-shaped media in which the lid is adapted to be releasably affixed to the beverage container and where the lid is protected from the beverage within the container and wherein the disc may be removed from the lid and utilized for entertainment purposes.

U.S. Patent Application Publication No. 2010/0264150, authored by Leon et al., describes a disposable beverage cup a disposable beverage cup that comprises a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

U.S. Patent Application Publication No. 2010/0320220, which was authored by Hussey et al., describes a plastic lid for a drinks container, for example, a coffee cup. The plastic lid is provided with an ancillary access facility in the form of an opening or a part of the lid easily removable to form an opening. The ancillary access facility allows a person to drink from the container without removal of the lid. After the ancillary access facility has been cleaned or de-contaminated it is protected by the application of a protective cover.

The protective cover may have a variety of shapes, for example, it may cover the entire lid or it may cover only a selected part of the lid, for example, only the area of the lid involving the ancillary access facility. The protective cover protects the ancillary access facility from the inadvertent transfer of germs to the drinking area by the person dispensing the drinks as they push the lid down with their hands to seal the lid to the container top. The protective covers are arranged to be easily stripped from the lid by the application of mere finger pressure.

U.S. Patent Application Publication No. 2011/0127267, authored by Leach, describes a reusable, flexible beverage lid designed to fit various beverage containers. The beverage lid includes a drink through cover portion having a generally circular periphery and a flexible sidewall with a profile enabling sealing against varying dimensioned beverage containers. The shape of the sidewall profile allows the lid to reliably seal and be easily assembled against various beverage containers and is generally consistent circumferentially. The lid design is such that it can be scaled radially to fit a further amount of beverage containers. The import of the Leach application is a flexible/expandable seal for accommodating container rims of differing sizes.

U.S. Patent Application Publication No. 2013/0256394, authored by Moutty, describes a paper cup comprising a sidewall member having an upper edge, a lower edge, a pair of opposite side edges, a front surface and a back surface. Each of the side edges and the upper edge define upper corners. The side edges are overlapped and are sealed together along an overlapping side seam. A bottom member comprises a peripheral lip sealed to the lower edge of the sidewall member. The Moutty paper cup construction is remarkable in that it further comprises at least one rigid or semi-rigid rim structure attached to the upper edge of the side wall member and in that the paper weight of the bottom member is greater than the paper weight of the sidewall member.

U.S. Patent Application Publication No. 2014/0231419, authored by Vadlamani et al. describes certain food product embodiments comprising both a consumable container and/or a microwavable food container in combination with a food composition. The containers may include a bottom wall and a side wall, which bottom wall may include a microwave reflector, while the side wall may include a material that is substantially transparent to microwaves. The microwave reflector can cover at least about 80 percent of the surface area of the bottom wall.

SUMMARY OF THE INVENTION

The primary objective of this invention is to provide a liquid container lid assembly for enabling controlled liquid egression from a liquid container. The alternative lid assemblies according to the present invention each preferably comprise a lower lid construction and an upper lid construction. The lower lid construction preferably comprises a lid-to-container fastening means as exemplified by a rim-receiving groove, and an upper-receiving depression or offset depression feature. The upper-receiving depression comprises at least one liquid-letting aperture or lower liquid-letting aperture. The lid-to-container fastening groove removably fastens the lower lid construction to an upper container rim of a liquid container. The upper-receiving depression preferably comprises concave upper portion surfacing as at surfacing.

Alternative upper lid constructions are nestable in superior adjacency to the upper-receiving depression and comprise lower-opposing portions and a primary liquid outlet or upper aperture. The lower-opposing portions comprise convex lower portion surfacing. The convex lower portion surfacing mimics the concave upper portion surfacing for eliminating gaps therebetween. The primary liquid outlet is orientable in superior adjacency the lower lid construction by moving the upper lid constructions relative the lower lid construction for selectively outletting liquid received in an assembly-outfitted container. The reader will thus note that the claimed embodiment, in is basic structure, may provide fully open and fully closed positions only.

The lower lid construction preferably comprises or provides a knob-receiving groove and the upper lid constructions preferably comprise or provide a downwardly extending knob. The downwardly extending knob is translatably receivable in the knob-receiving groove when the upper lid constructions are nested down atop the upper-receiving depression. The knob-receiving groove and the downwardly extending knob are together cooperable for guiding movement of the upper lid constructions relative to the lower lid construction for enabling the user to more effectively control liquid egression from the outfitted liquid container.

The downwardly extending knob preferably comprises a certain knob-girth and the knob-receiving groove preferably comprises opposed groove ends and a central section intermediate the opposed groove (or tight) ends. At least one of the opposed groove ends is structurally configured for resistively receiving the knob-girth of the knob for providing haptic feedback to the user that the downwardly extending knob is entering the at least one of the opposed groove ends. The opposed groove ends and the downwardly extending knob provide movement stop structure or upper lid construction stop structure associated with either the fully open lid configuration or the fully closed lid configuration. Thus, the haptic feedback informs the user of the user's fully open or fully closed lid configuration.

Although it is contemplated that at least one of the groove ends be configured for resistively receiving the knob-girth for providing haptic feedback to the user that the downwardly extending knob is entering either of the opposed groove ends it is preferable that each of the opposed groove ends are so configured for informing the user of the user's fully open or fully closed lid configuration. The groove end associated with the fully closed configuration is preferably outfitted with an air-letting aperture, which air-letting aperture basically functions to enhance pressure equalization and enhanced liquid egression via the lid assemblies when the lid assemblies are in a select open configuration according to state of the art principles. It is believed inventive, however, to provide a downwardly extending knob that covers the air-letting aperture when received in the groove end associated with the fully closed configuration for restricting pressure equalization and preventing liquid egression via the lid assemblies.

The upper lid construction preferably comprises a raised formation, which raised formation and the lower portion surfacing together define a liquid-receiving cavity or compartmental space when the upper lid constructions are nested atop the upper-receiving depression. The liquid-receiving cavity or compartmental space may receive and shape a liquid volume receivable therein via the at least one liquid-letting aperture before the liquid volume exits the primary liquid outlet. The raised formation may further preferably comprise primary liquid outlet flanking portions as at stem portions. A select primary liquid outlet flanking portion or stem portion is positionable in superior adjacency to the at least one liquid-letting aperture as at the first partially open lid configuration for receiving liquid from the outfitted liquid container and diverting liquid toward the primary liquid outlet under the action of flanking portion diversion.

The flanking portion diversion delays liquid delivery and enhances heat transfer from the liquid prior to liquid egression via the primary liquid outlet. The raised formation may further preferably comprise upper formation surfacing, which surfacing is parallel to the convex lower portion surfacing and the primary liquid outlet flanking portions comprise upper flank portions that extend obliquely relative to the upper formation surfacing for enhancing redirection of liquid toward the primary liquid outlet. The at least one liquid-letting aperture preferably comprises a raised peripheral ridge, which raised peripheral ridge has upper ridge apex surfacing for engaging the lower portion surfacing during movement of the upper lid constructions relative to the lower lid construction for enhancing compartmentalization of liquid within the outfitted liquid container.

Similarly, the primary liquid outlet is preferably bordered by a downwardly extending ridge formation. The downwardly extending ridge formation has lower ridge apex surfacing for engaging the upper portion surfacing during movement of the upper lid constructions relative to the lower lid construction for enhancing compartmentalization of liquid within the outfitted liquid container. The lid-to-container fastening groove radially and uniformly extends about a primary lid axis, and the upper-receiving depression radially and uniformly extends about a depression axis. The depression axis is parallel to the primary lid axis and thus the depression is preferably and centrally offset relative to the groove. The upper lid constructions are rotatably nestable atop the lower lid construction for enabling a user to rotate the upper lid constructions about an axis relative to the lower lid construction for selectively orienting the primary lid outlet in superior adjacency to the at least one liquid-letting aperture.

The lower lid construction preferably comprises an edge-receiving groove, and the upper lid constructions preferably comprises a peripheral outer edge. The peripheral outer edge is preferably and rotatably received in the edge-receiving groove for rotatably attaching the upper lid constructions to the lower lid construction. The upper lid constructions may be preferably constructed from or comprise a resilient material. Thus, the upper lid constructions may be actuated and nested or actuably nested atop the upper-receiving depression for enhancing fitted engagement of the upper lid constructions relative to the lower lid construction via the resiliently directed return forces of the material construction of the upper lid constructions.

Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of my invention will become more evident from a consideration of the following brief descriptions of patent drawings.

Figure 2A:
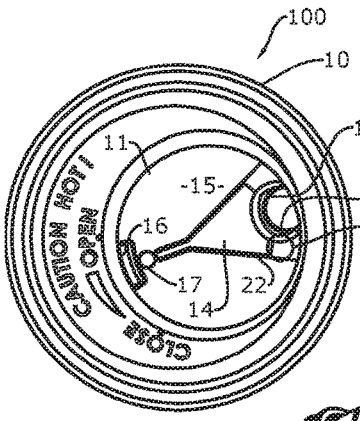
FIG. 2A is a first top plan view of the first alternative lid assembly according to the present invention, the first alternative lid assembly being in the first partially open configuration for outletting beverage at the rate less than the maximum rate.
Figure 2:
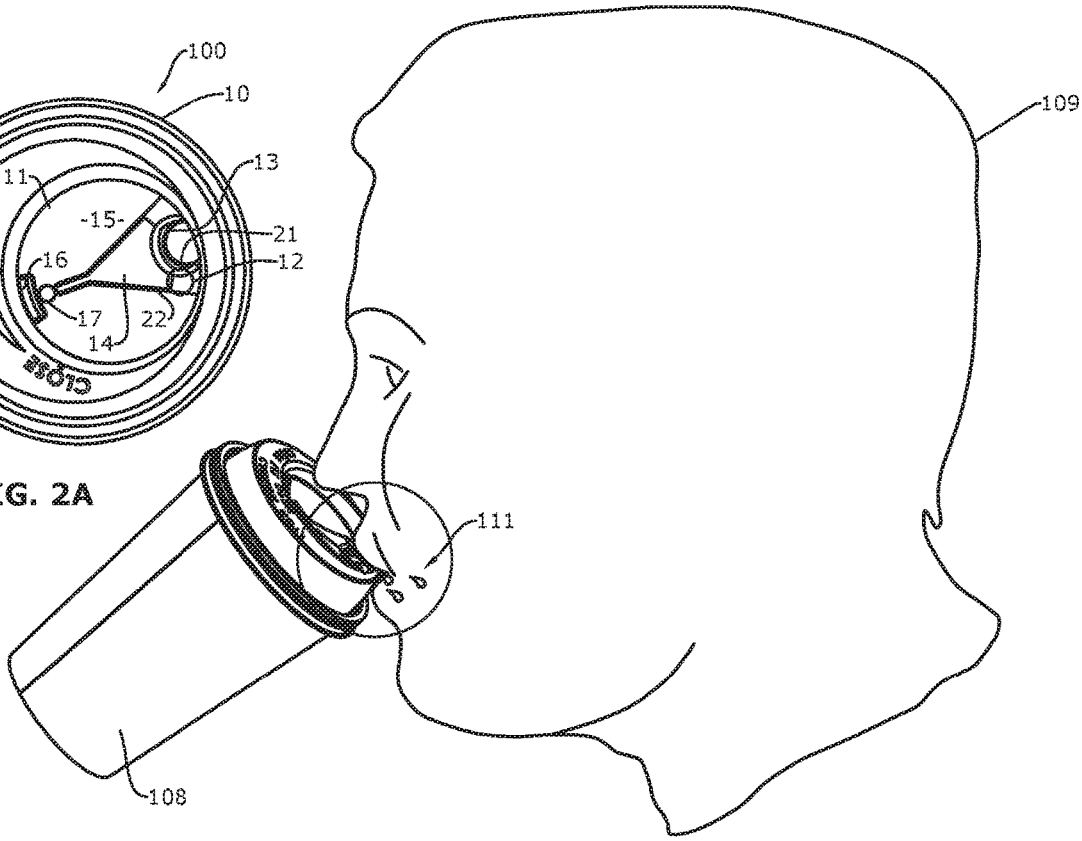
FIG. 2 is a second fragmentary depiction of a user consuming beverage from a container outfitted with the first alternative lid assembly according to the present invention, the first alternative lid assembly being in a first partially open configuration for outletting beverage at a rate less than the maximum rate.
Figure 2B:
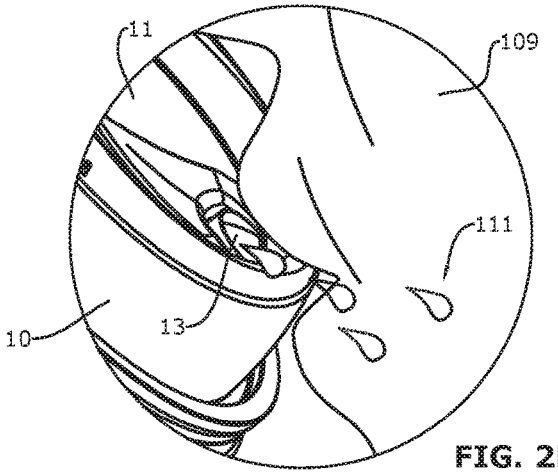

FIG. 2B is an enlarged fragmentary sectional depiction as enlarged and sectioned from FIG. 2 to more clearly depict the interface where the user is consuming beverage from the container outfitted with the first alternative lid assembly according to the present invention, the first alternative lid assembly being in the first partially open configuration for outletting beverage at the rate less than the maximum rate.

Figure 1A:
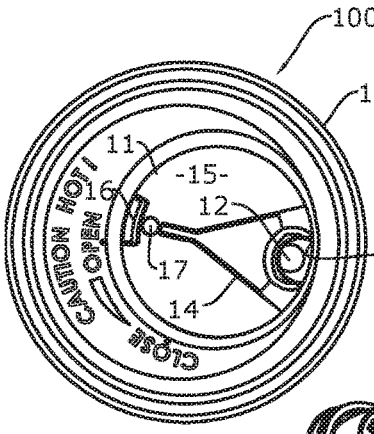
FIG. 1A is a top plan view of the first alternative lid assembly according to the present invention, the first alternative lid assembly being in the fully open configuration for outletting beverage at a maximum rate.
Figure 1:
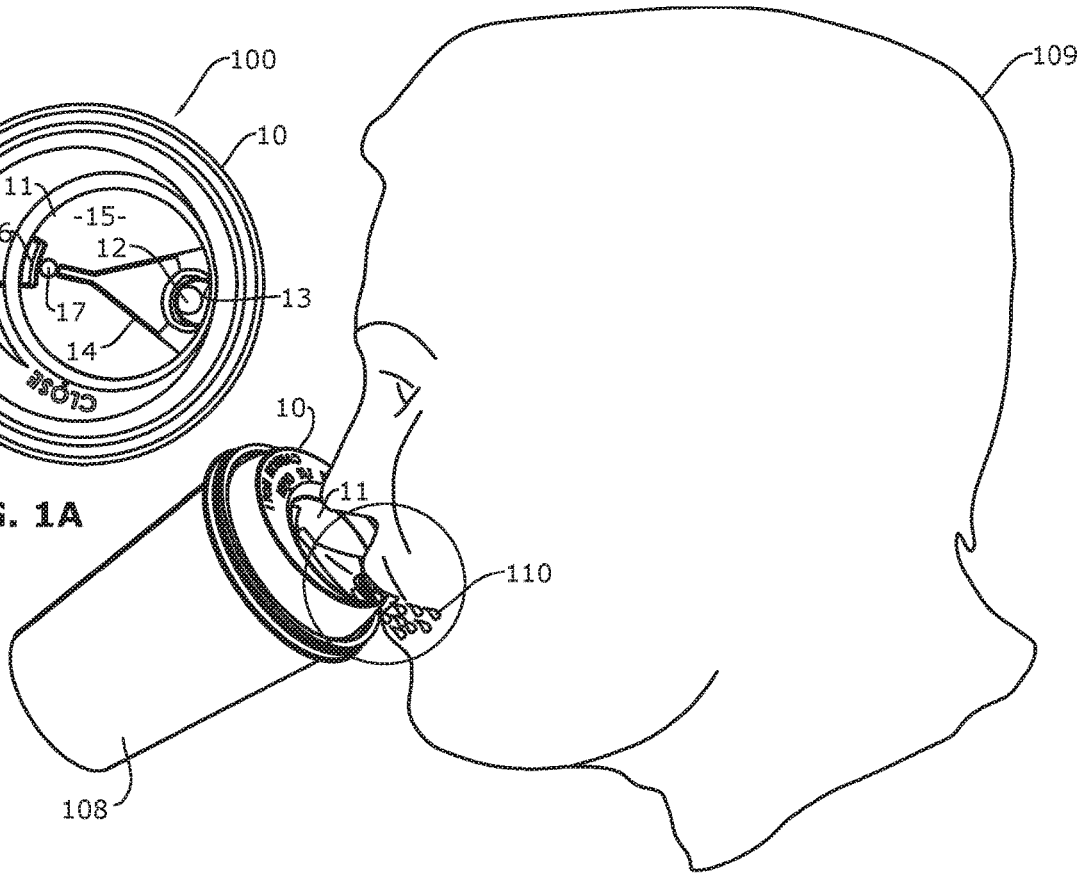
FIG. 1 is a first fragmentary depiction of a user consuming beverage from a container outfitted with a first alternative lid assembly according to the present invention, the first alternative lid assembly being in a fully open configuration for outletting beverage at a maximum rate.
Figure 1B:
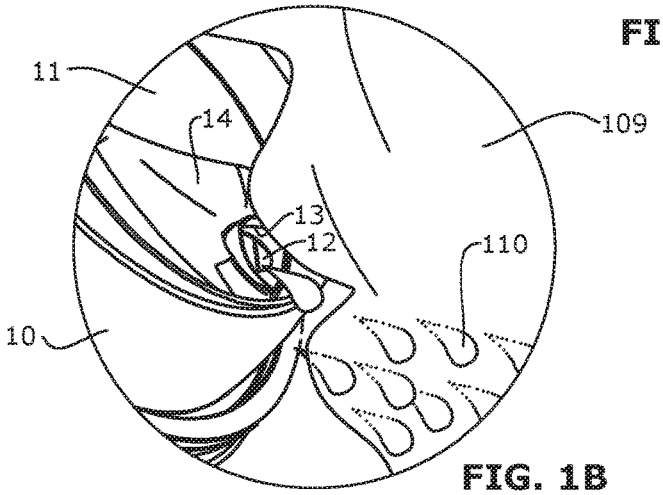
FIG. 1B is an enlarged fragmentary sectional depiction as enlarged and sectioned from FIG. 1 to more clearly depict the interface where the user is consuming beverage from the container outfitted with the first alternative lid assembly according to the present invention, the first alternative lid assembly being in the fully open configuration for outletting beverage at a maximum rate.
Figure 1C:
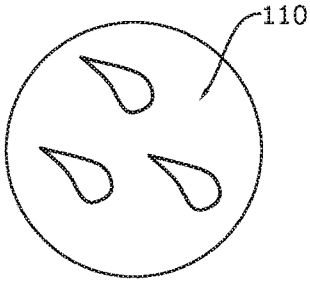
FIG. 1C is an enlarged schematic depiction of three relatively large beverage droplets to schematically denote the maximum rate of beverage egress from the container outfitted with the first alternative lid assembly in the fully open configuration.
Figure 2C:
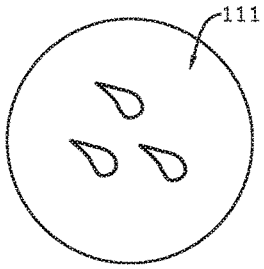

FIG. 2C is an enlarged schematic depiction of three beverage droplets relatively smaller than the three relatively large beverage droplets otherwise shown in FIG. 1C to schematically denote the maximum rate of beverage egress from the container outfitted with the first alternative lid assembly in the first partially open configuration.

Figure 2D:
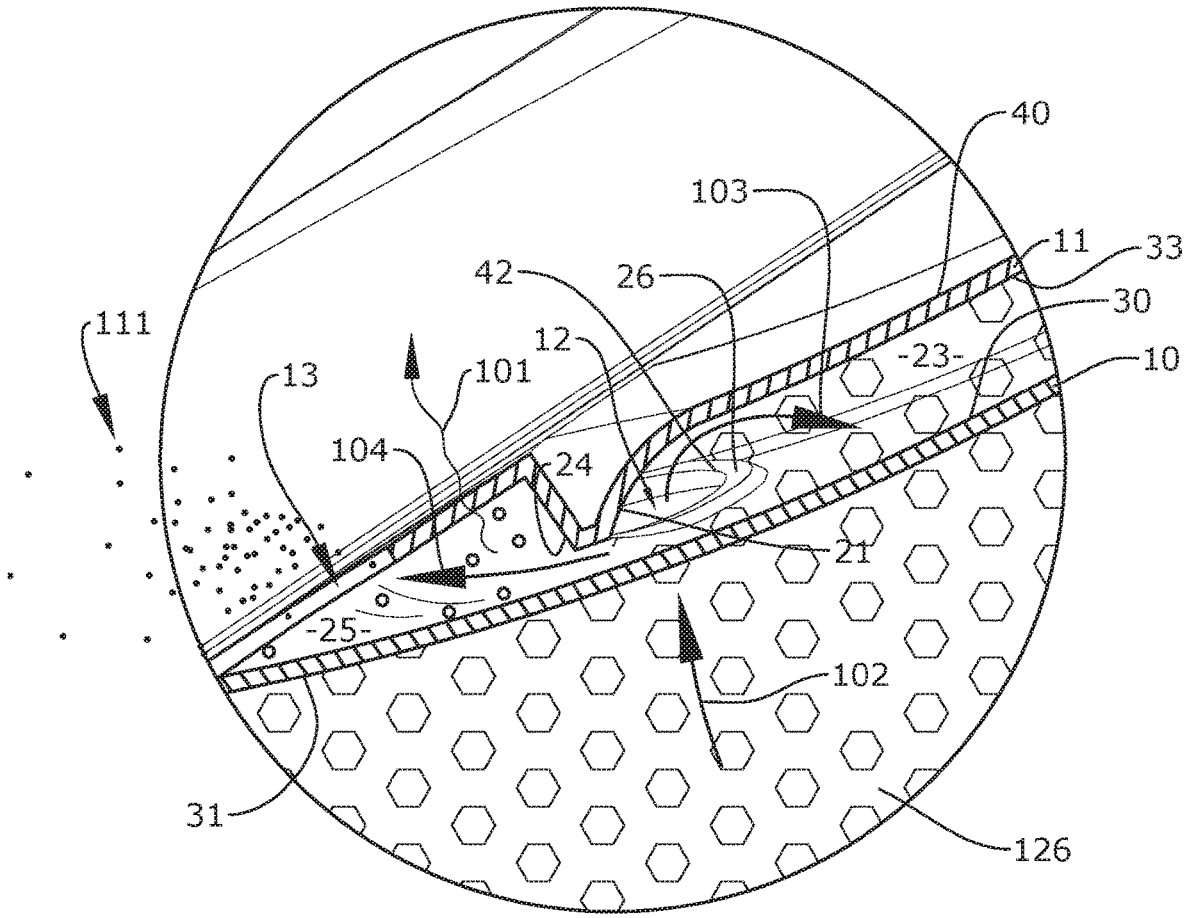

FIG. 2D is an enlarged, fragmentary cross-sectional depiction of the first alternative lid assembly at the site where beverage egresses from the container through the first partially open lid assembly to show the structures associated with the lid assembly at the site and to depict beverage flow therethrough when in the first partially open configuration.

Figure 3A:
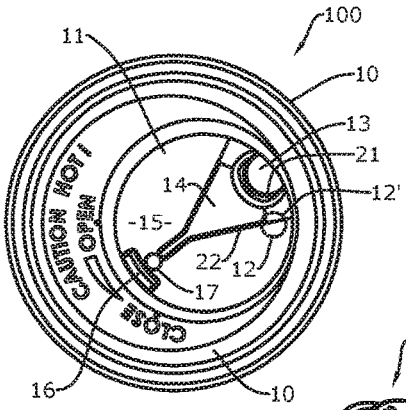
Figure 3:
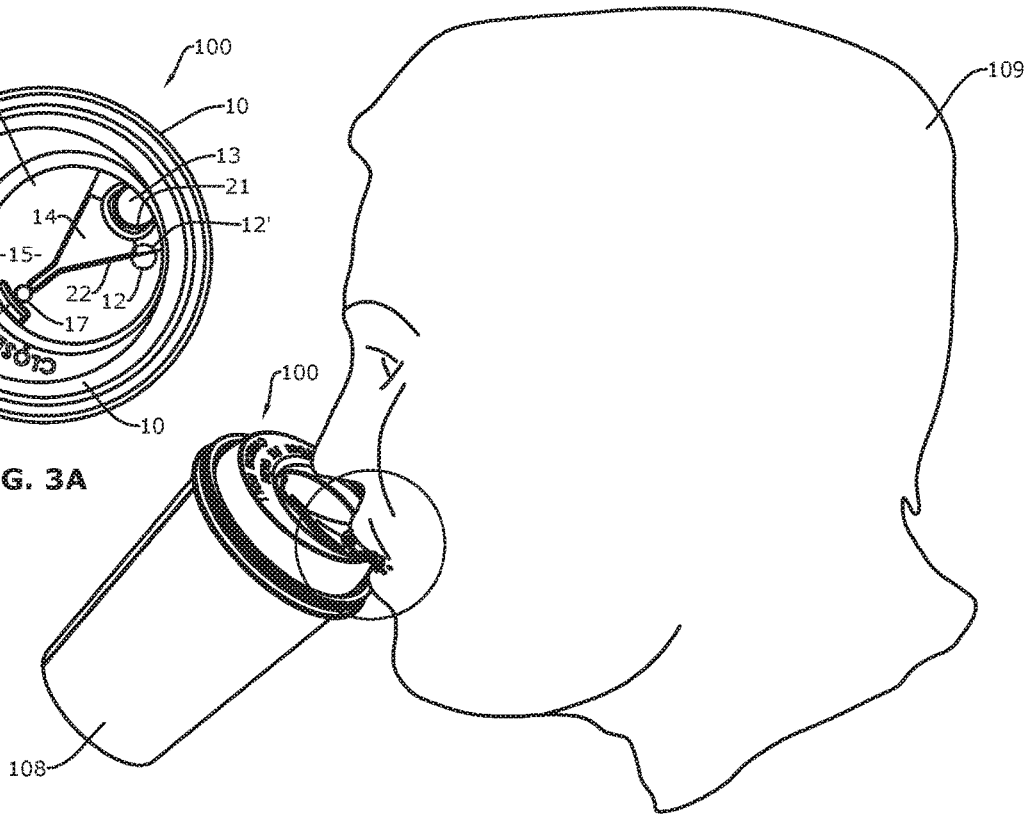

FIG. 3 is a third fragmentary depiction of a user consuming beverage from a container outfitted with the first alternative lid assembly according to the present invention, the first alternative lid assembly being in a second partially open configuration for outletting beverage at a minimum rate.

FIG. 3A is a first top plan view of the first alternative lid assembly according to the present invention, the first alternative lid assembly being in the second partially open configuration for outletting beverage at the minimum rate.

Figure 3B:
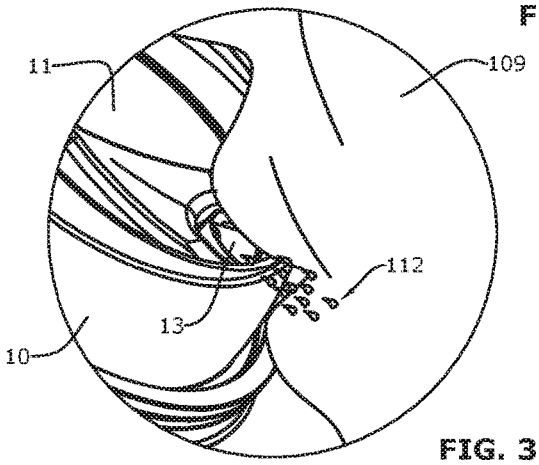

FIG. 3B is an enlarged fragmentary sectional depiction as enlarged and sectioned from FIG. 3 to more clearly depict the interface where the user is consuming beverage from the container outfitted with the first alternative lid assembly according to the present invention, the first alternative lid assembly being in the second partially open configuration for outletting beverage at the minimum rate.

Figure 3C:
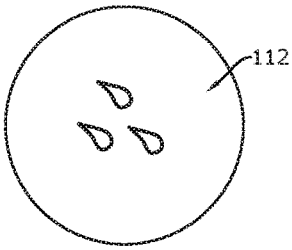

FIG. 3C is an enlarged schematic depiction of three beverage droplets relatively smaller than the three beverage droplets otherwise shown in FIG. 2C to schematically denote the minimum rate of beverage egress from the container outfitted with the first alternative lid assembly in the second partially open configuration.

Figure 4:
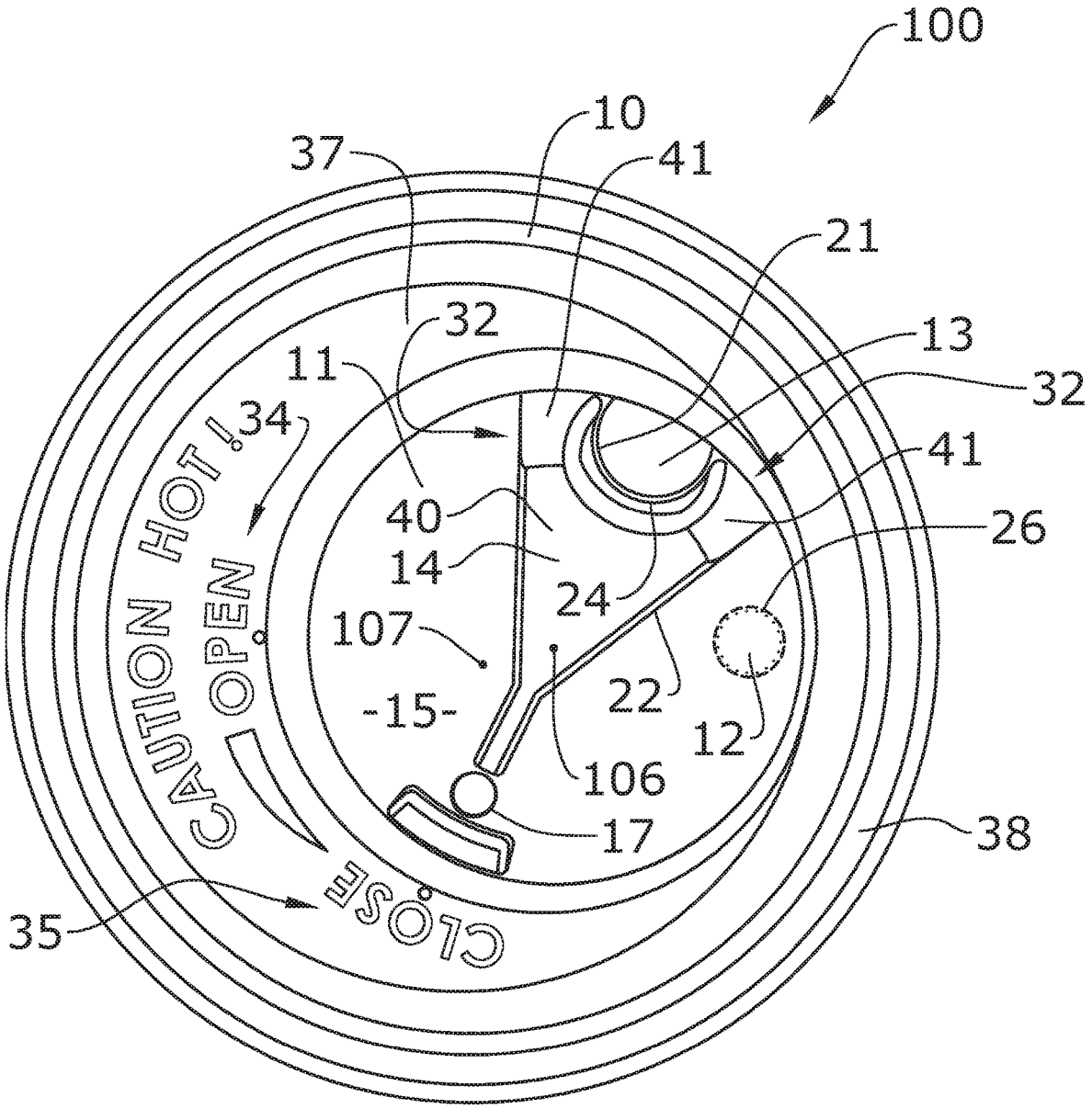

FIG. 4 is an enlarged top plan view of the first alternative lid assembly according to the present invention, the first alternative lid assembly being depicted in the closed configuration for preventing beverage egress from the outfitted container.

Figure 4A:
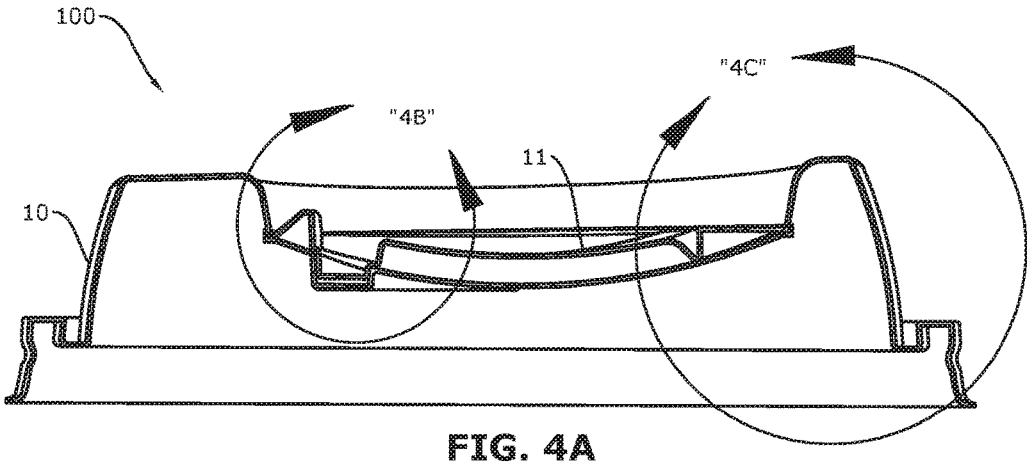

FIG. 4A is a longitudinally transverse cross-section through the first alternative lid assembly to show how the upper lid construction is assembled in relation to the lower lid construction.

Figure 4B:
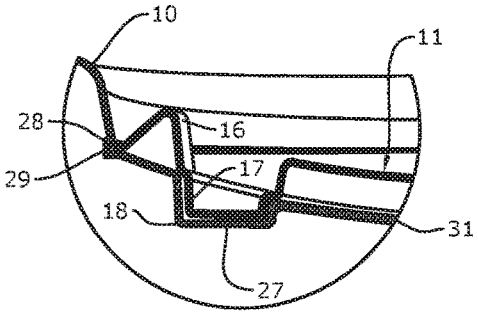

FIG. 4B is an enlarged, fragmentary sectional view as enlarged and sectioned from FIG. 4A to more clearly depict a lower knob of the upper lid construction seated or received in a groove formed in the lower lid construction.

Figure 4C:
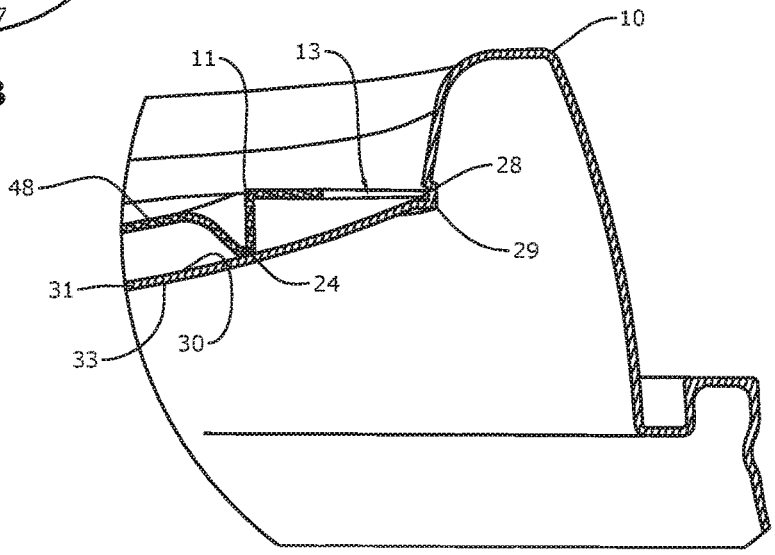

FIG. 4C is an enlarged, fragmentary sectional view as enlarged and sectioned from FIG. 4A to more clearly depict an arcuate ridge formation of the upper lid construction in contact with upper surfacing of the lower lid construction and an outer periphery of the upper lid construction received in an edge-receiving groove of the lower lid construction.

Figure 4D:
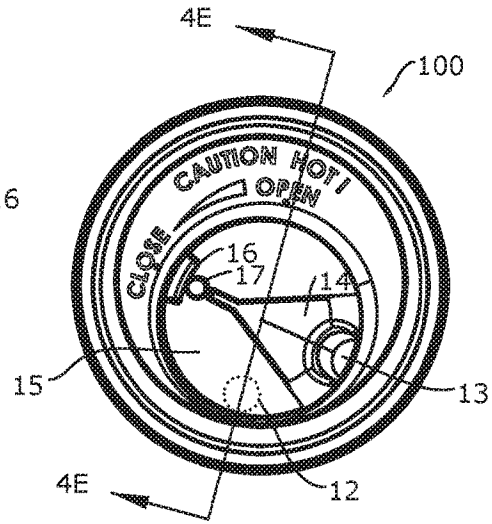

FIG. 4D is a reduced top plan view of the first alternative lid assembly according to the present invention, the first alternative lid assembly being depicted in the closed configuration for preventing beverage egress from the outfitted container.

Figure 4G:
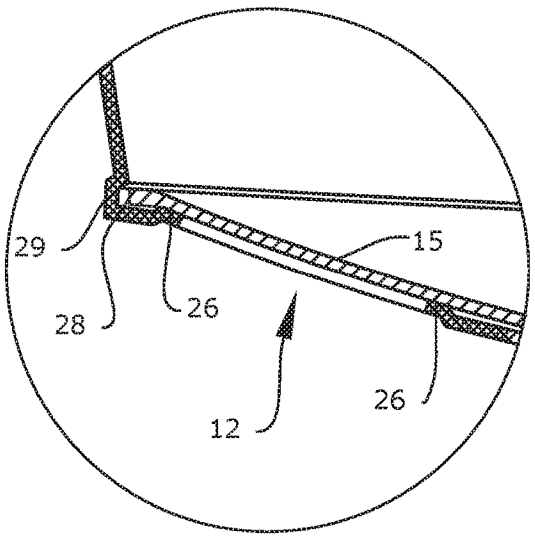
Figure 4F:
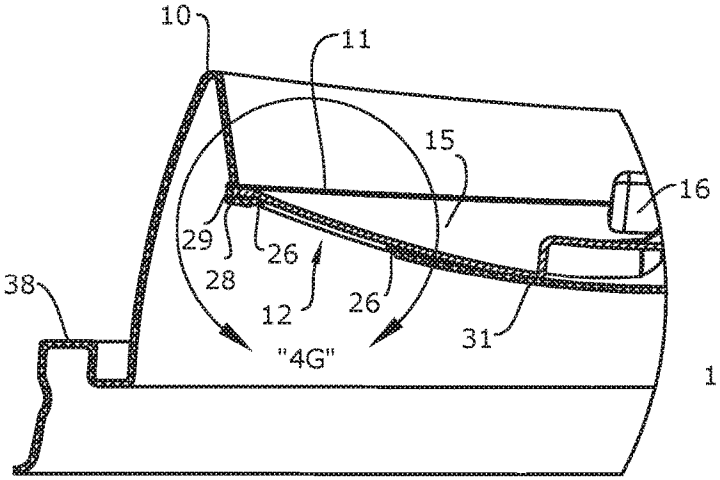
Figure 4E:
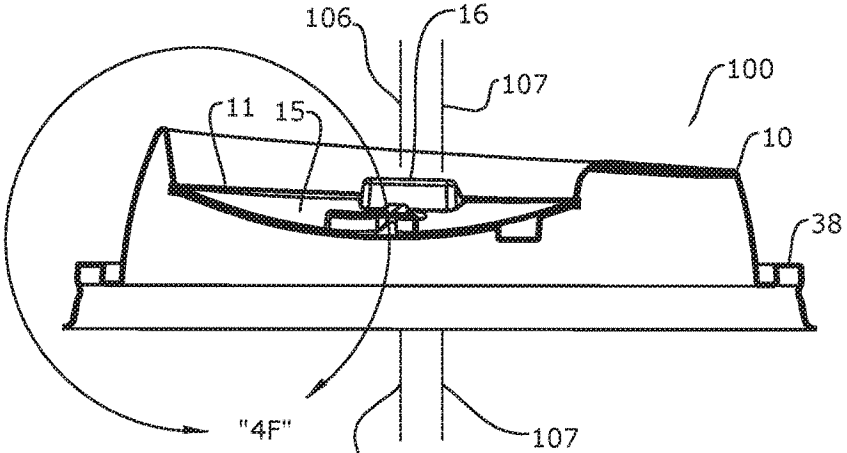

FIG. 4E is a longitudinally transverse cross-section through the first alternative lid assembly otherwise shown in FIG. 4D and through a lower aperture formed in the lower lid construction.

FIG. 4F is an enlarged fragmentary sectional view as enlarged and sectioned from FIG. 4E to show in greater clarity the lower aperture formed in the lower lid construction relative to the upper lid construction when in the fully closed configuration.

FIG. 4G is an enlarged fragmentary sectional view as enlarged and sectioned from FIG. 4F to show in still greater clarity the lower aperture formed in the lower lid construction relative to the upper lid construction when in the fully closed configuration, the span section overlying the raised peripheral ridge encircling the lower aperture formed in the lower lid construction.

Figure 5A:
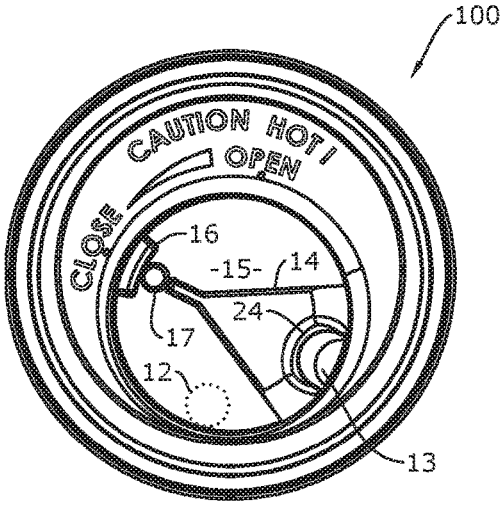

FIG. 5A is a third top plan view of the first alternative lid assembly according to the present invention, the first alternative lid assembly being depicted in the closed configuration for preventing beverage egress from the outfitted container.

Figure 5B:
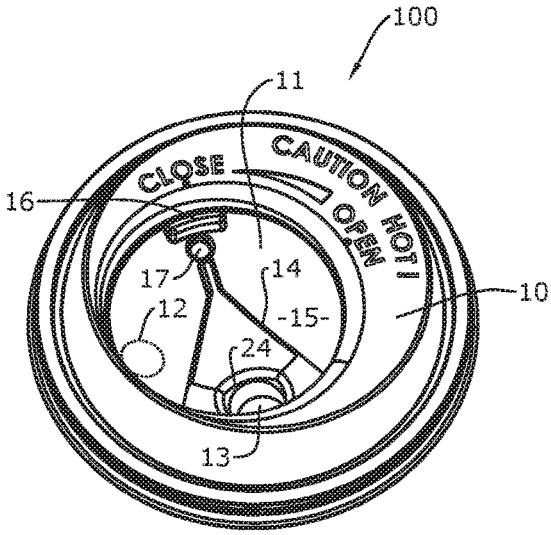

FIG. 5B is a top perspective view of the first alternative lid assembly according to the present invention, the first alternative lid assembly being depicted in the closed configuration for preventing beverage egress from the outfitted container.

Figure 5C:
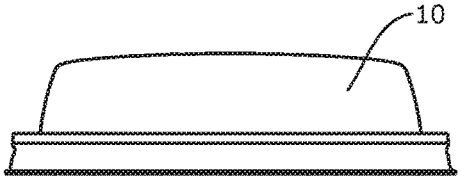

FIG. 5C is a first anterior elevational view of the first alternative lid assembly according to the present invention.

Figure 5D:
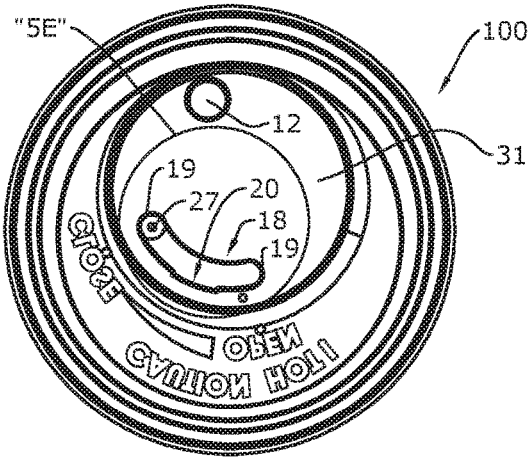

FIG. 5D is a bottom plan view of the first alternative lid assembly according to the present invention, the first alternative lid assembly being depicted in the closed configuration for preventing beverage egress from the outfitted container.

Figure 5E:
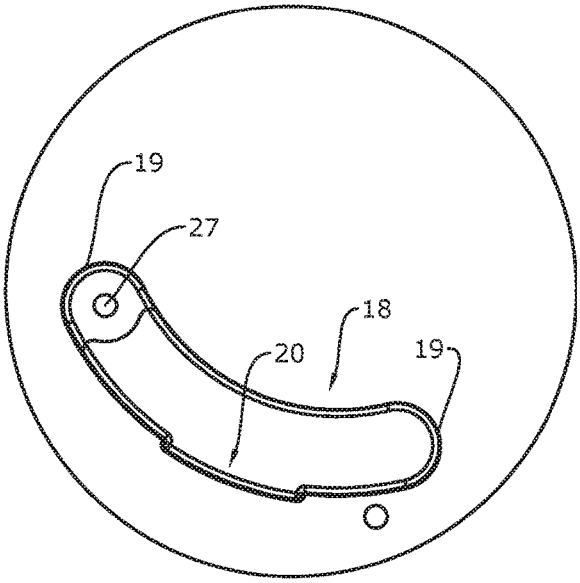

FIG. 5E is an enlarged view of a knob-receiving/guiding groove formed on the underside of an offset depression formed in the lower lid construction according to the present invention as enlarged from FIG. 5D and showing a relatively wide central section intermediate opposed relatively narrow groove ends.

Figure 6:
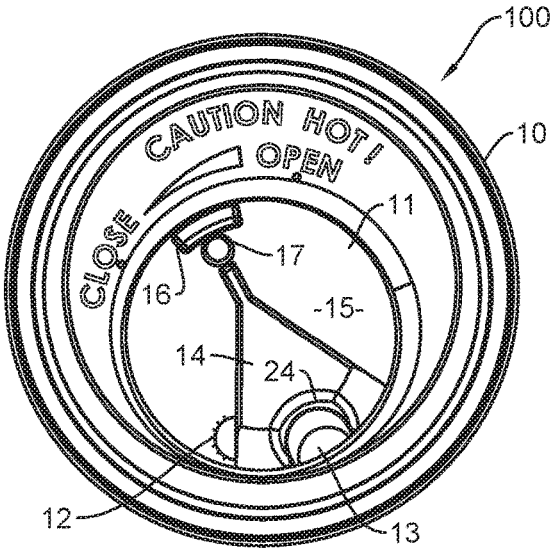

FIG. 6 is a second top plan view of the first alternative lid assembly according to the present invention, the first alternative lid assembly being depicted in the second partially open configuration for outletting beverage at the minimum rate.

Figure 7:
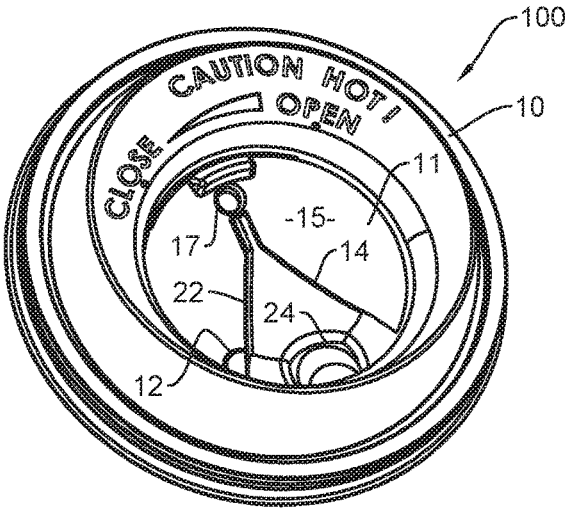

FIG. 7 is a top perspective view of the first alternative lid assembly according to the present invention, the first alternative lid assembly being depicted in the second partially open configuration for outletting beverage at the minimum rate.

Figure 8:
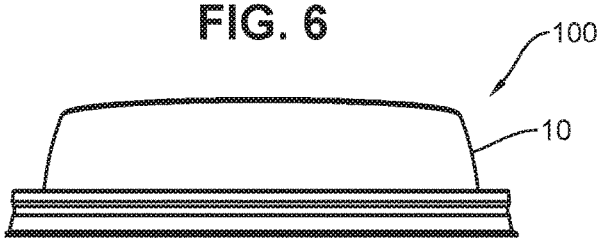

FIG. 8 is a second anterior elevational view of the first alternative lid assembly according to the present invention.

Figure 9:
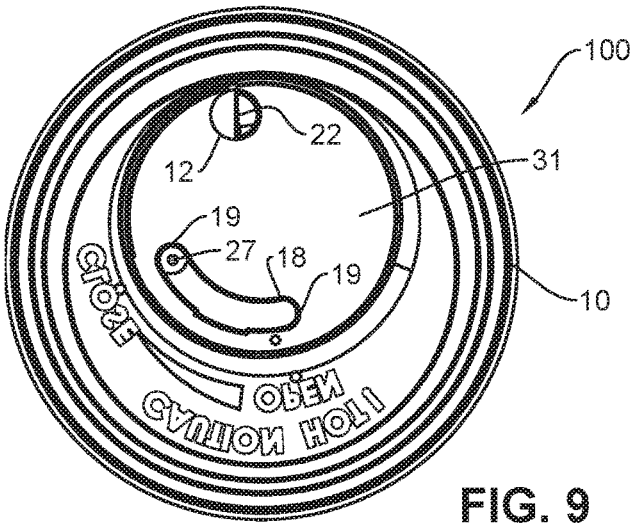

FIG. 9 is a bottom plan view of the first alternative lid assembly according to the present invention, the first alternative lid assembly being depicted in the second partially open configuration for outletting beverage at the minimum rate.

Figure 10:
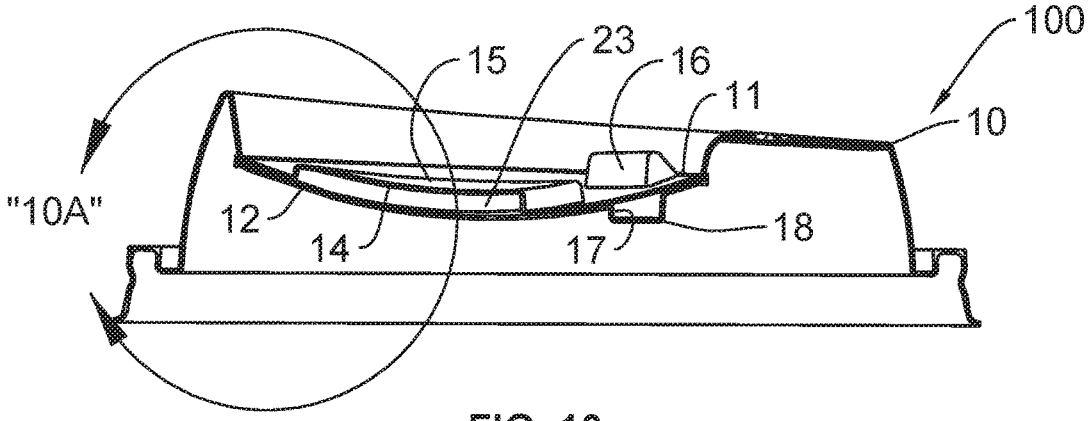

FIG. 10 is a longitudinally transverse cross-section through the first alternative lid assembly and through the lower aperture formed in the lower lid construction.

Figure 10A:
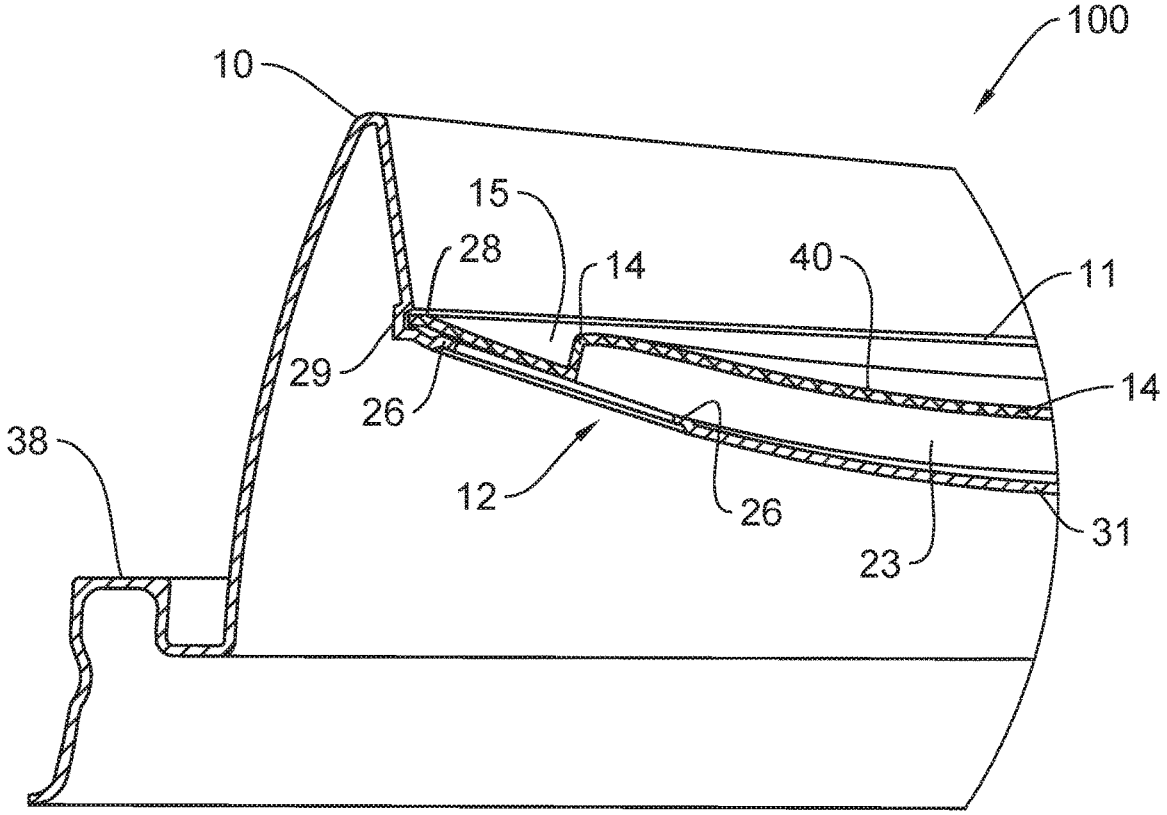

FIG. 10A is an enlarged fragmentary sectional view as enlarged and sectioned from FIG. 10 to show in greater clarity the lower aperture formed in the lower lid construction partially covered by a lateral edge portion of the upper lid construction when in the second partially open configuration.

Figure 11A:
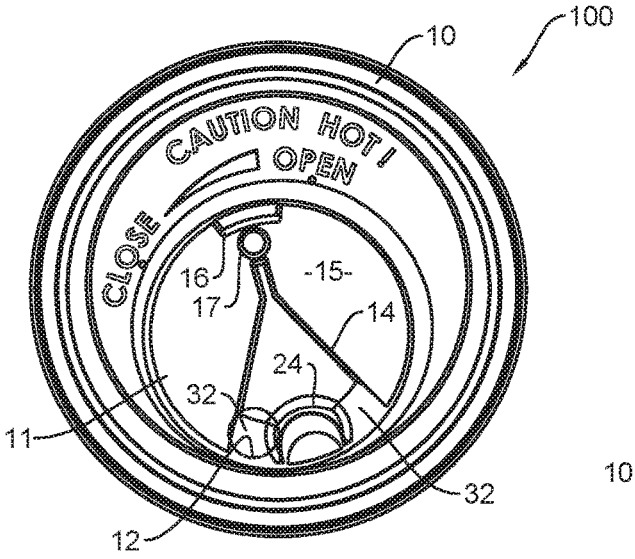

FIG. 11A is a second top plan view of the first alternative lid assembly according to the present invention, the first alternative lid assembly being depicted in the first partially open configuration for outletting beverage at a rate less than the minimum rate.

Figure 11B:
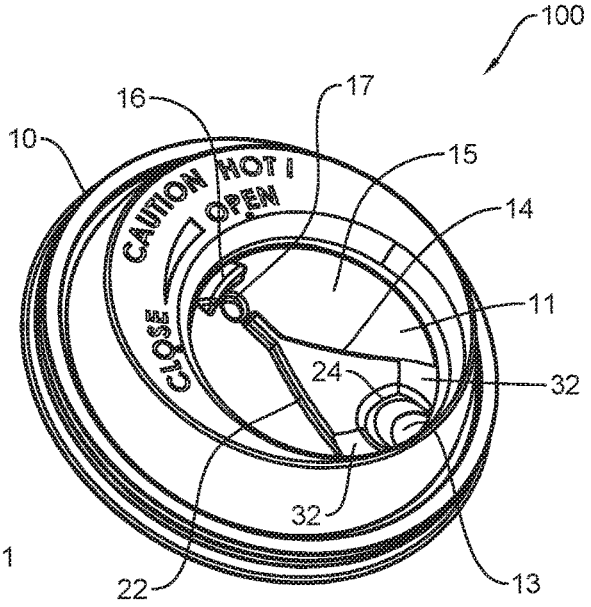

FIG. 11B is a top perspective view of the first alternative lid assembly according to the present invention, the first alternative lid assembly being depicted in the first partially open configuration for outletting beverage at a rate less than the minimum rate.

Figure 11C:
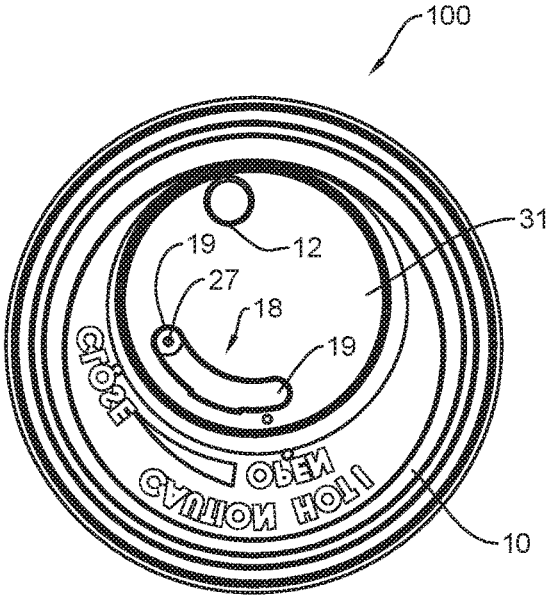

FIG. 11C is a bottom plan view of the first alternative lid assembly according to the present invention, the first alternative lid assembly being depicted in the first partially open configuration for outletting beverage at a rate less than the minimum rate.

Figure 12:
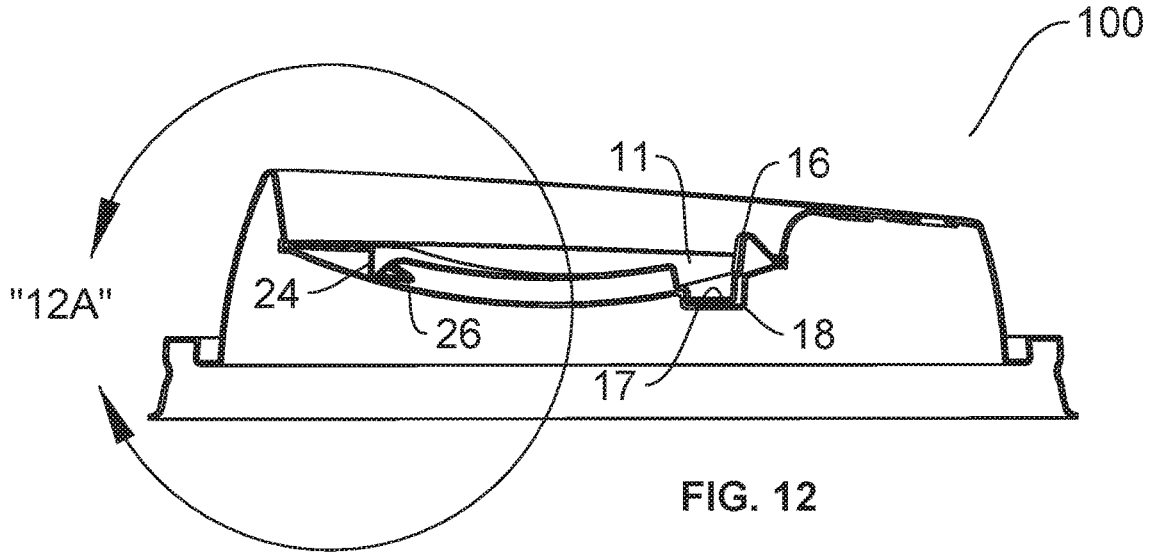

FIG. 12 is a longitudinally transverse cross-section through the first alternative lid assembly and in adjacency to the lower aperture formed in the lower lid construction.

Figure 12A:
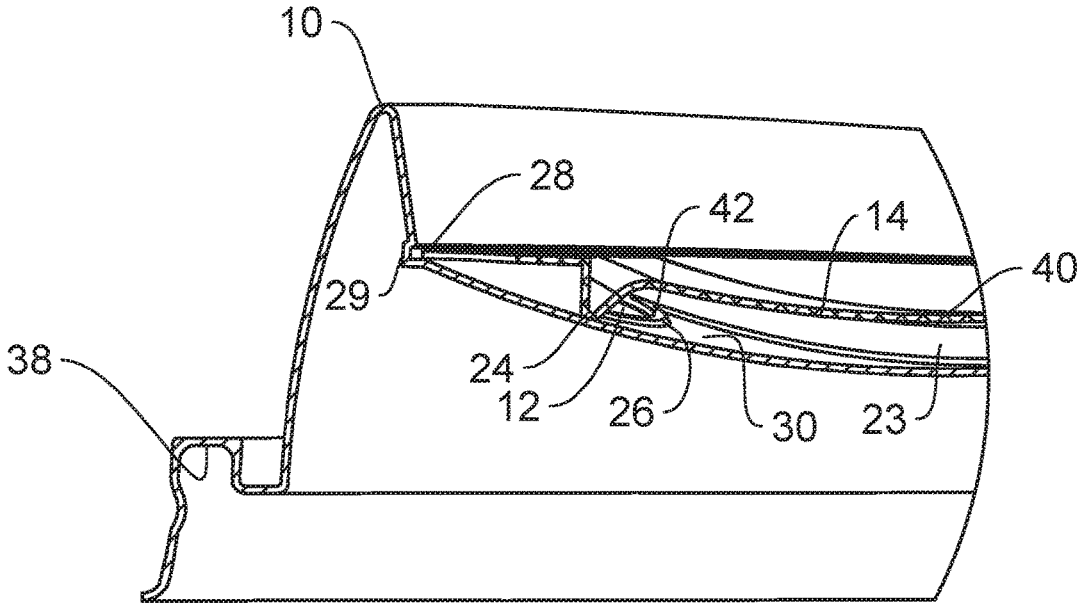

FIG. 12A is an enlarged fragmentary sectional view as enlarged and sectioned from FIG. 12 to show in greater clarity the lower aperture formed in the lower lid construction in structural relation to the arcuate ridge formation of the upper lid construction when in the second partially open configuration.

Figure 13:
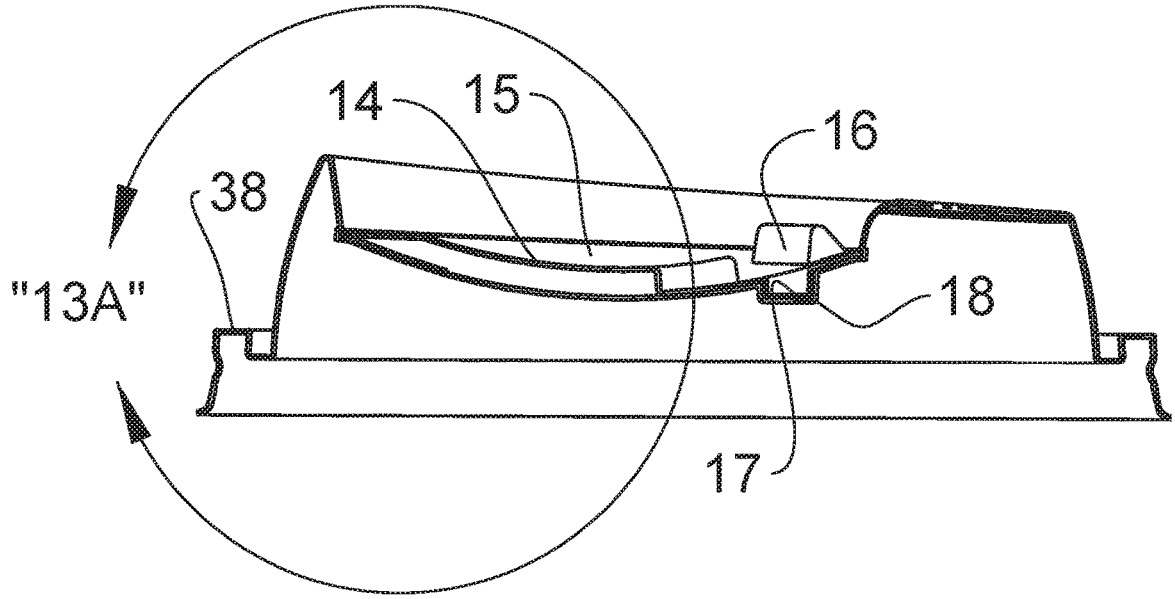

FIG. 13 is a longitudinally transverse cross-section through the first alternative lid assembly and through the lower aperture formed in the lower lid construction.

Figure 13A:
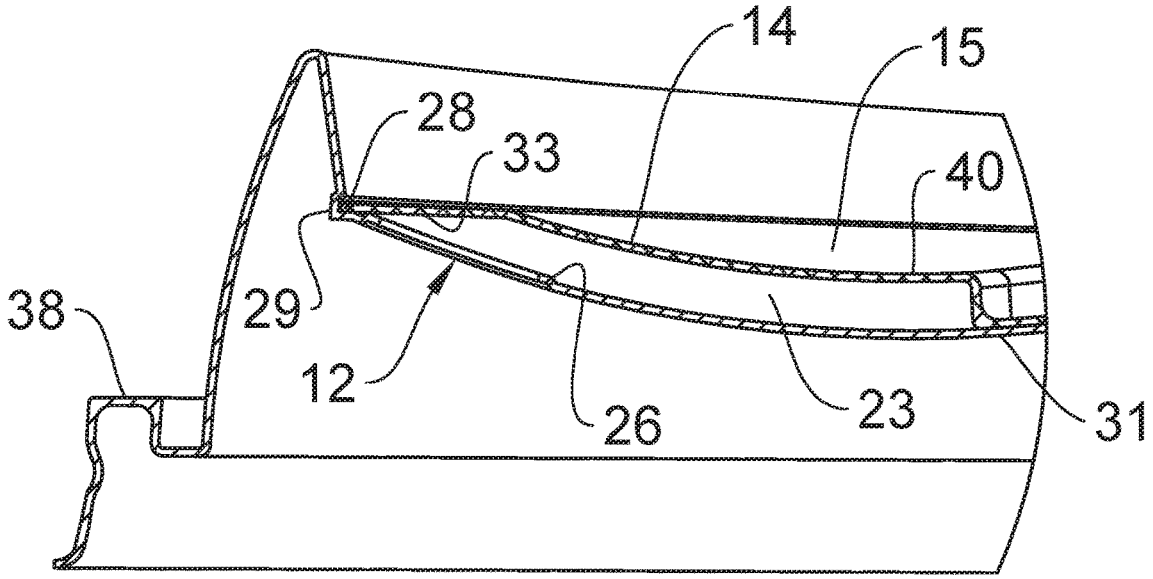

FIG. 13A is an enlarged fragmentary sectional view as enlarged and sectioned from FIG. 13 to show in greater clarity the lower aperture formed in the lower lid construction in structural relation to the arcuate ridge formation of the upper lid construction when in the second partially open configuration.

Figure 14A:
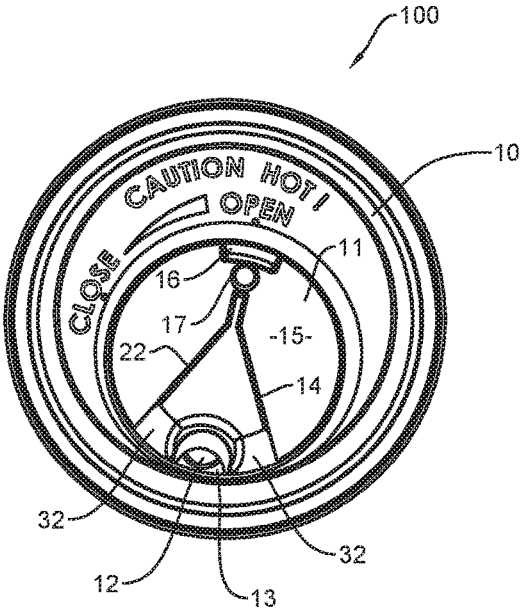

FIG. 14A is a first top plan view of the first alternative lid assembly according to the present invention, the first alternative lid assembly being depicted in the fully open configuration for outletting beverage at the maximum rate.

Figure 14B:
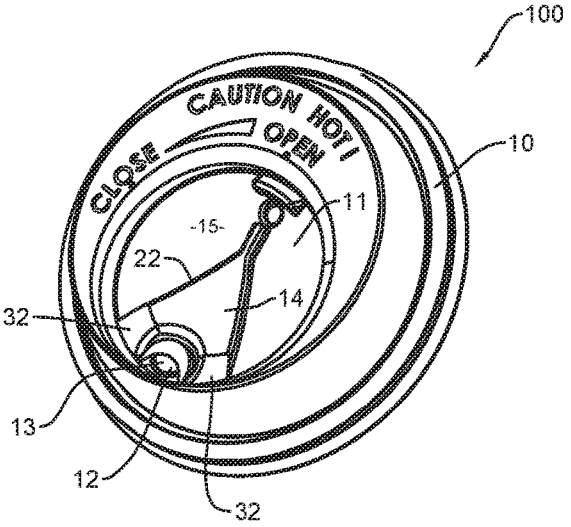

FIG. 14B is a top perspective view of the first alternative lid assembly according to the present invention, the first alternative lid assembly being depicted in the fully open configuration for outletting beverage at the maximum rate.

Figure 14C:
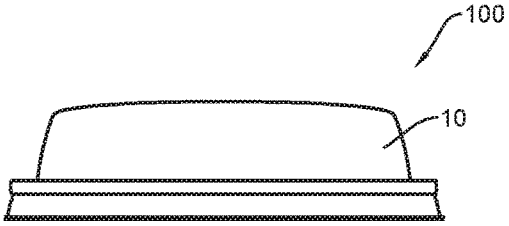

FIG. 14C is a third anterior elevational view of the first alternative lid assembly according to the present invention.

Figure 14D:
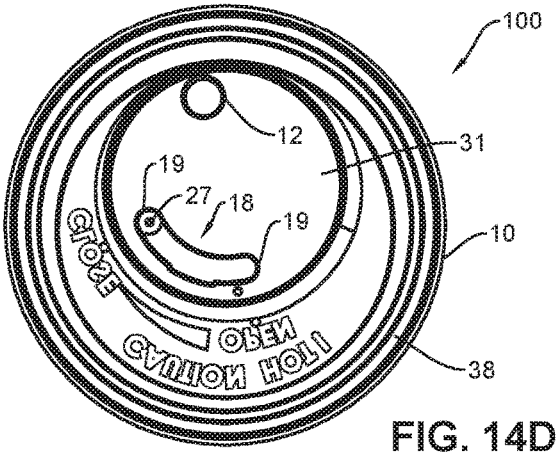

FIG. 14D is a bottom plan view of the first alternative lid assembly according to the present invention, the first alternative lid assembly being depicted in the fully open configuration for outletting beverage at the maximum rate.

Figure 15:
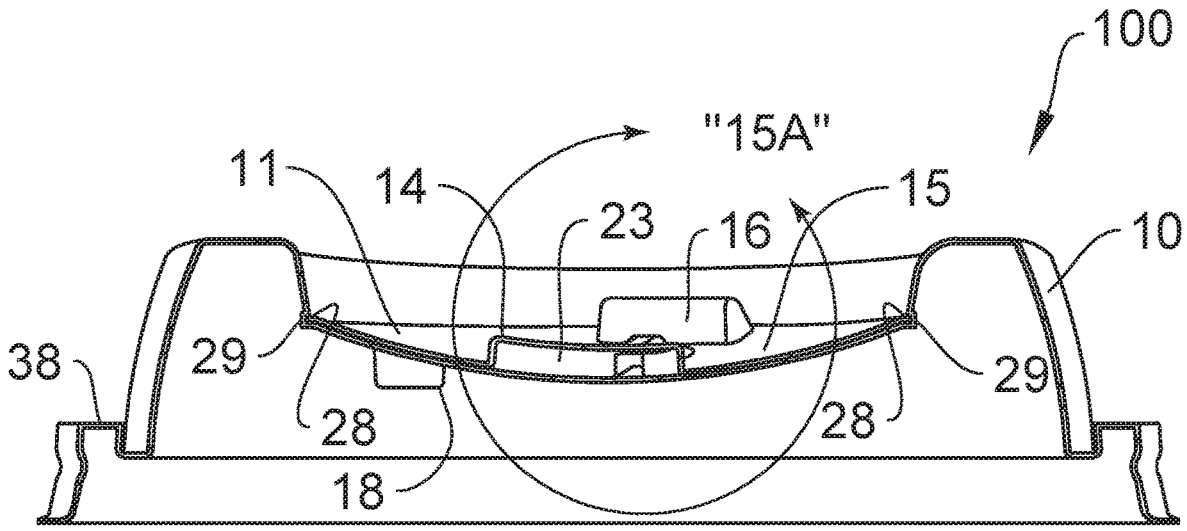

FIG. 15 is a longitudinally transverse cross-section through the first alternative lid assembly and transversely widthwise through a raised upper formation of the upper lid construction.

Figure 15A:
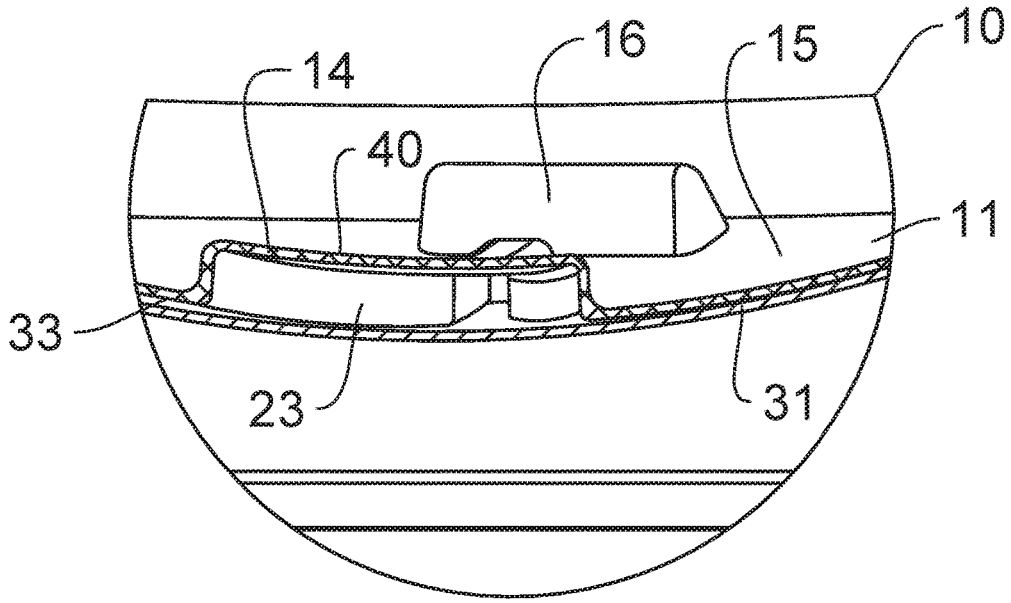

FIG. 15A is an enlarged fragmentary sectional view as enlarged and sectioned from FIG. 15 to show in greater clarity the structural relationship between the upper lid construction and lower lid construction when in the fully open configuration.

Figure 16:
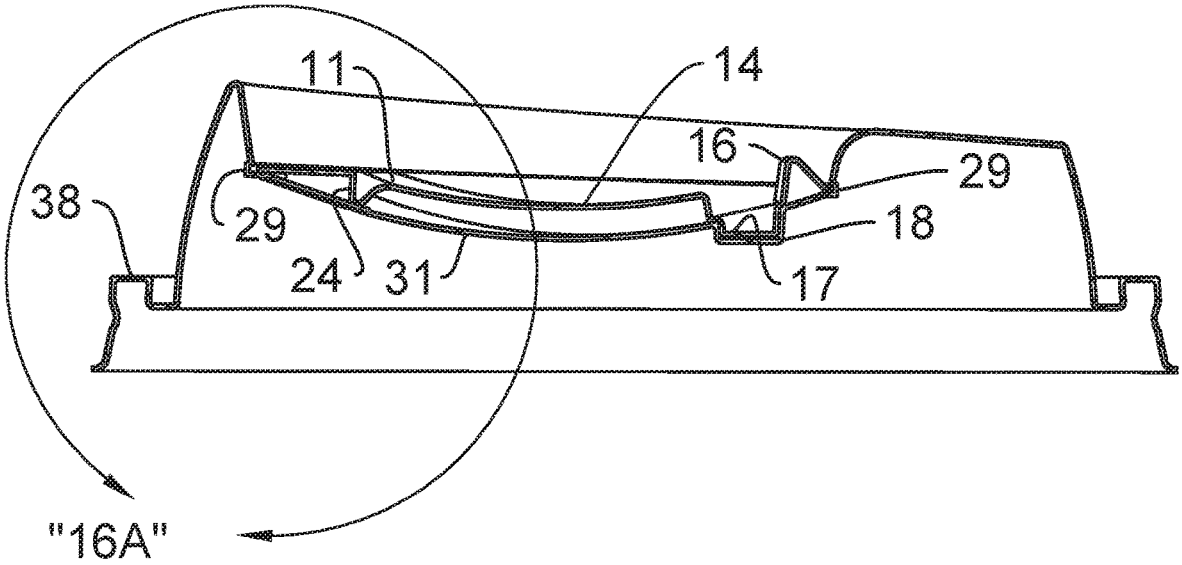

FIG. 16 is a longitudinally transverse cross-section through the first alternative lid assembly and transversely lengthwise through the raised upper formation of the upper lid construction and the lower aperture of the lower lid construction.

Figure 16A:
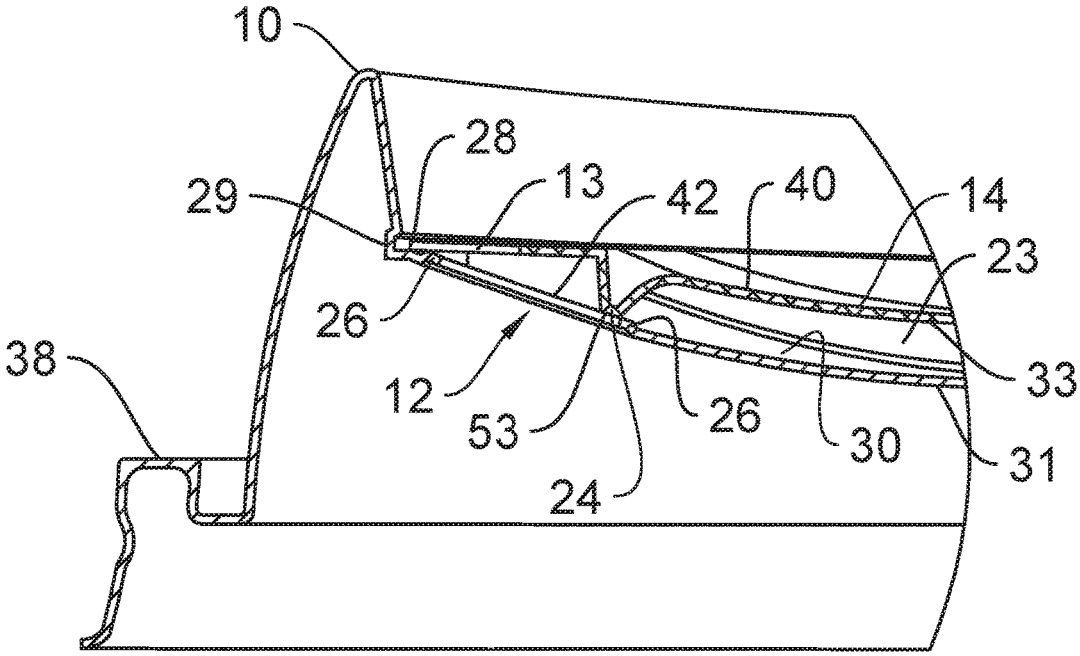

FIG. 16A is an enlarged fragmentary sectional view as enlarged and sectioned from FIG. 16 to show in greater clarity the structural relationship between the upper lid construction and lower lid construction relative to the lower aperture when in the fully open configuration.

Figure 17B:
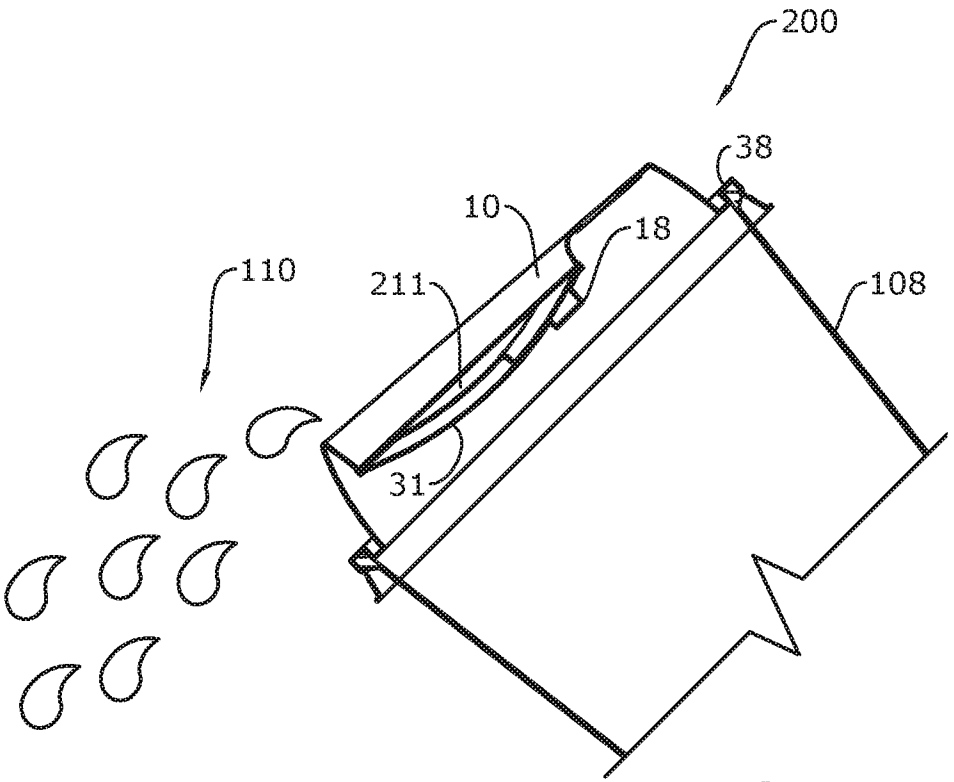
Figure 17A:
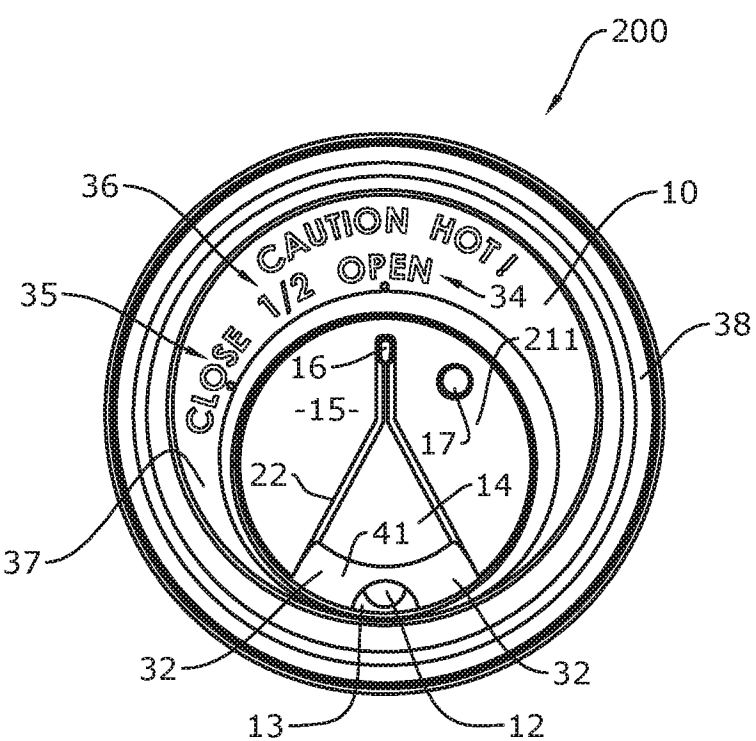

FIG. 17A is a top plan view of a second alternative lid assembly according to the present invention, the second alternative lid assembly being depicted in a fully open configuration for outletting beverage at a maximum rate.

FIG. 17B is a schematic depiction of eight beverage droplets being let from an outfitted container according to the second alternative lid assembly of the present invention to schematically denote the maximum rate of beverage egress from the container outfitted with the second alternative lid assembly in the fully open configuration.

Figure 18B:
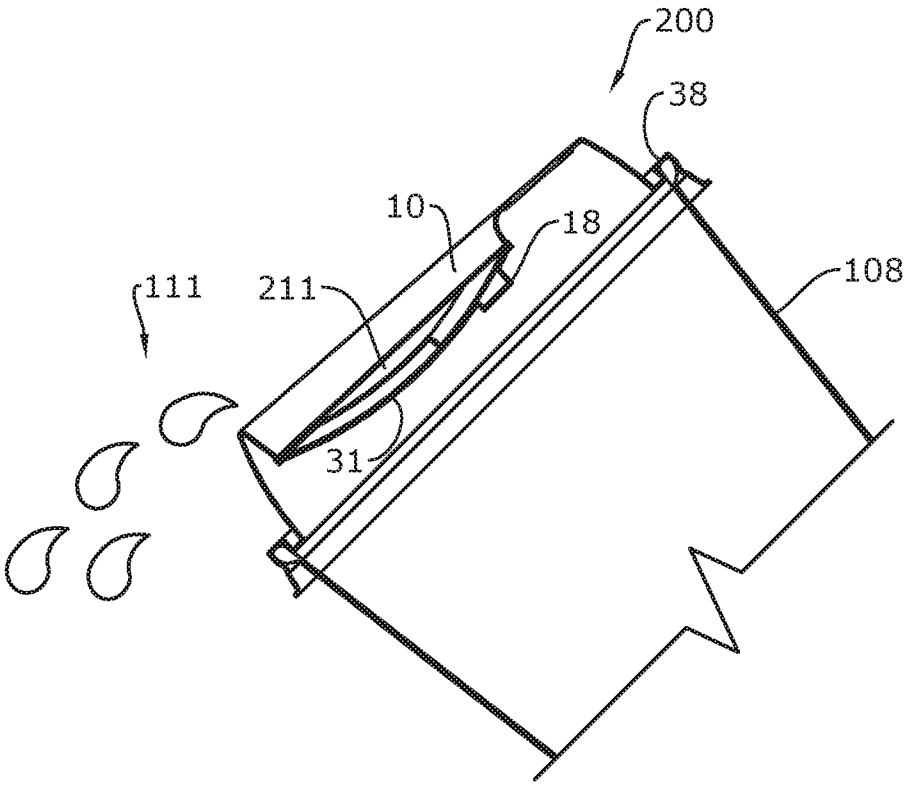
Figure 18A:
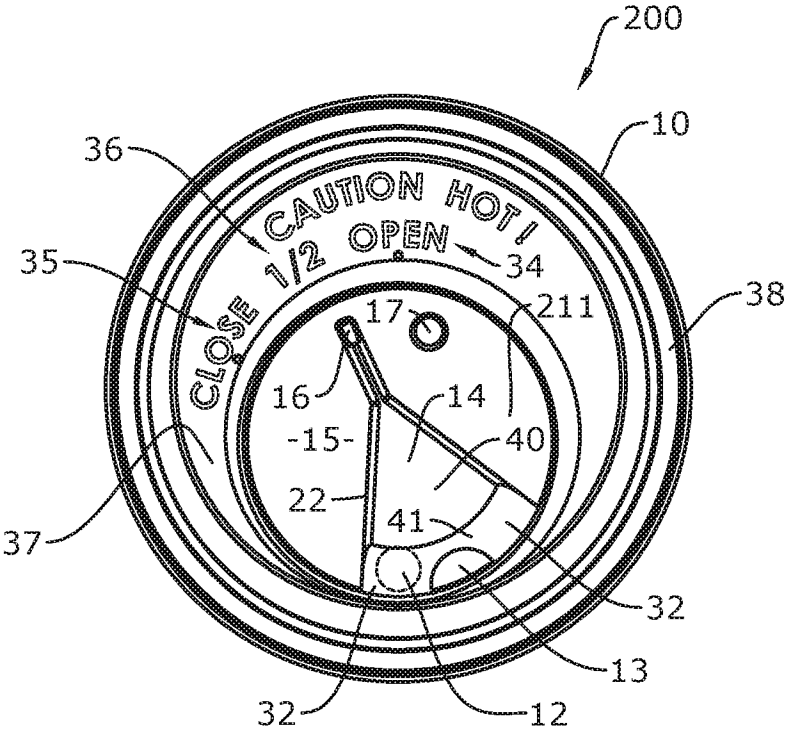

FIG. 18A is a top plan view of the second alternative lid assembly according to the present invention, the second alternative lid assembly being depicted in a first partially open configuration for outletting beverage at a rate less than the maximum rate.

FIG. 18B is a schematic depiction of four beverage droplets being let from an outfitted container according to the second alternative lid assembly of the present invention to schematically denote the rate less than the maximum rate of beverage egress from the container outfitted with the second alternative lid assembly in the first partially open configuration.

Figure 19B:
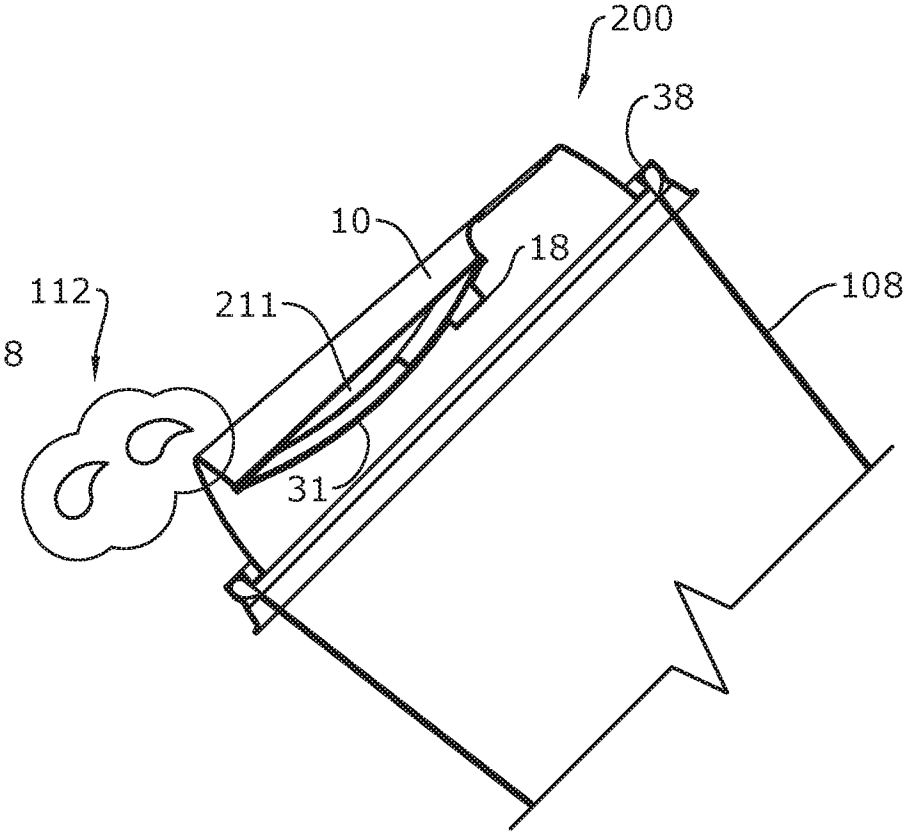
Figure 19A:
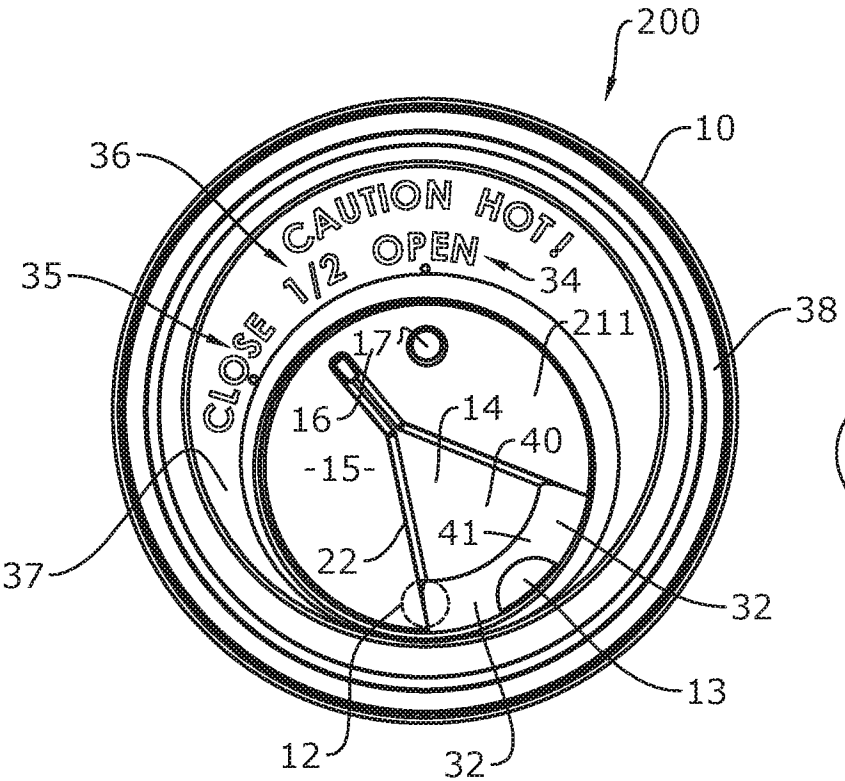

FIG. 19A is a top plan view of the second alternative lid assembly according to the present invention, the second alternative lid assembly being depicted in a second partially open configuration for outletting beverage at a minimum rate.

FIG. 19B is a schematic depiction of two beverage droplets being let from an outfitted container according to the second alternative lid assembly of the present invention to schematically denote the minimum rate of beverage egress from the container outfitted with the second alternative lid assembly in the second partially open configuration.

Figure 20B:
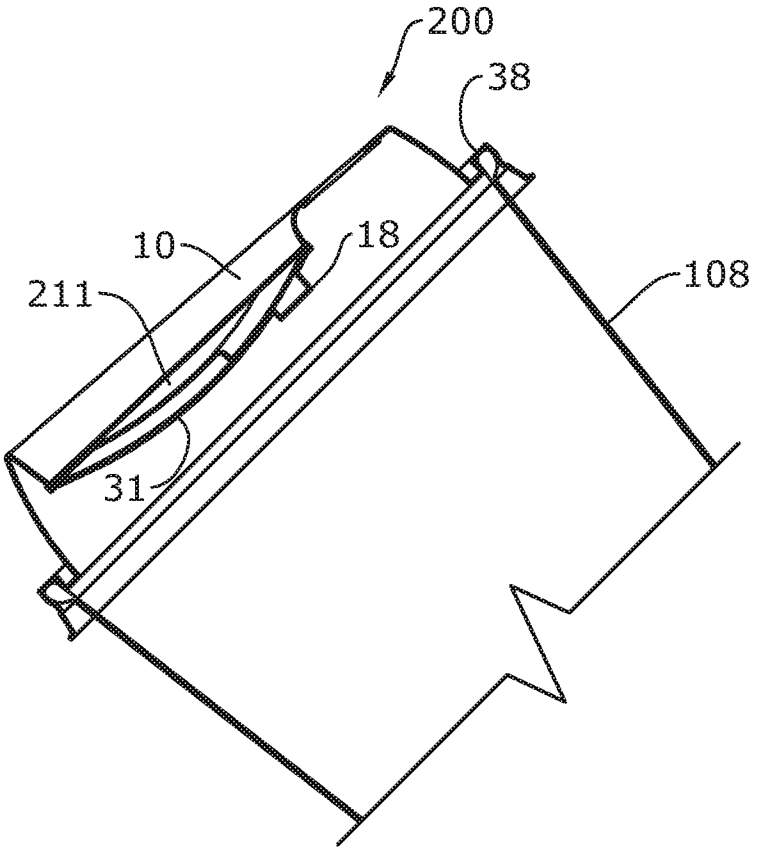
Figure 20A:
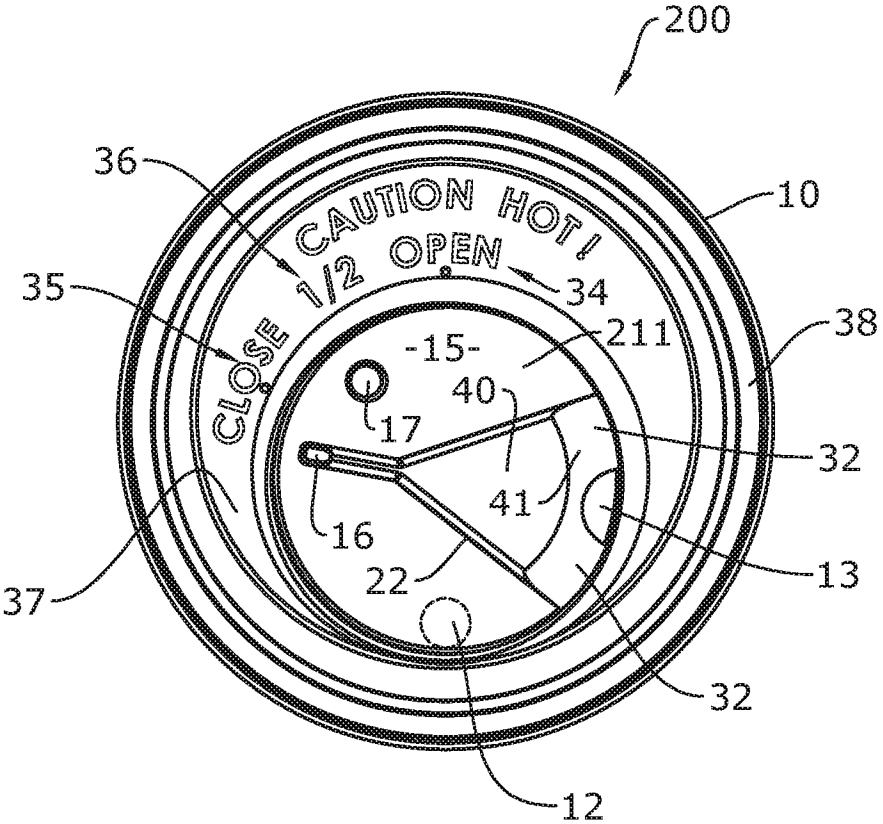

FIG. 20A is a top plan view of the second alternative lid assembly according to the present invention, the second alternative lid assembly being depicted in a fully closed configuration for preventing beverage egress from the outfitted container FIG. 20B is a schematic depiction of an absence of beverage droplets being let from an outfitted container according to the second alternative lid assembly of the present invention to schematically denote the prevention of beverage egress from the container outfitted with the second alternative lid assembly when in the full closed configuration.

Figure 21A:
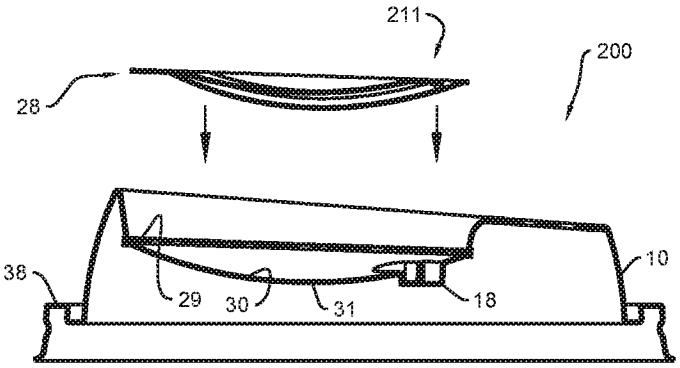
Figure 21:
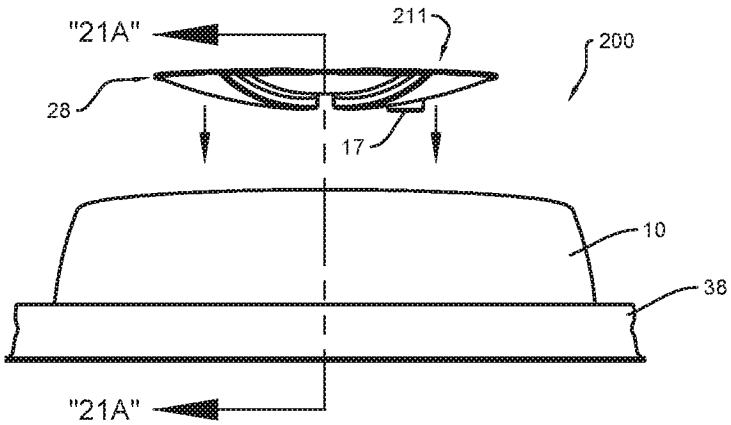

FIG. 21 is an exploded anterior view of the second alternative lid assembly according to the present invention, the upper lid construction being exploded from the lower lid construction.

FIG. 21A is an exploded longitudinal cross-section along the anterior-to-posterior medial plane of the second alternative lid assembly according to the present invention, the upper lid construction being exploded from the lower lid construction.

Figure 22A:
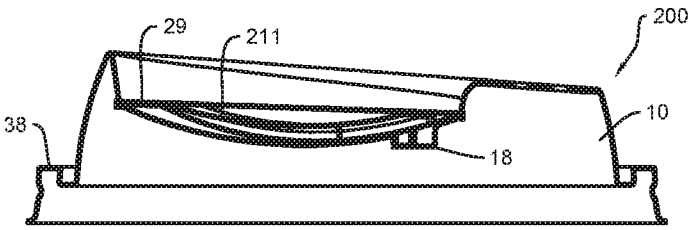
Figure 22:
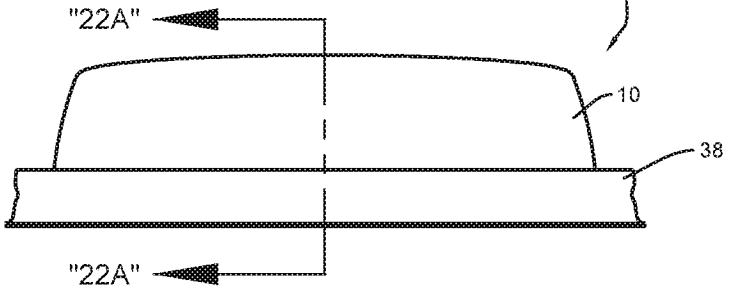

FIG. 22 is an assembled anterior view of the second alternative lid assembly according to the present invention.

FIG. 22A is an assembled longitudinal cross-section along the anterior-to-posterior medial plane of the second alternative lid assembly according to the present invention.

Figures 23, 23A, 23B, 23C, 23D, 23E:
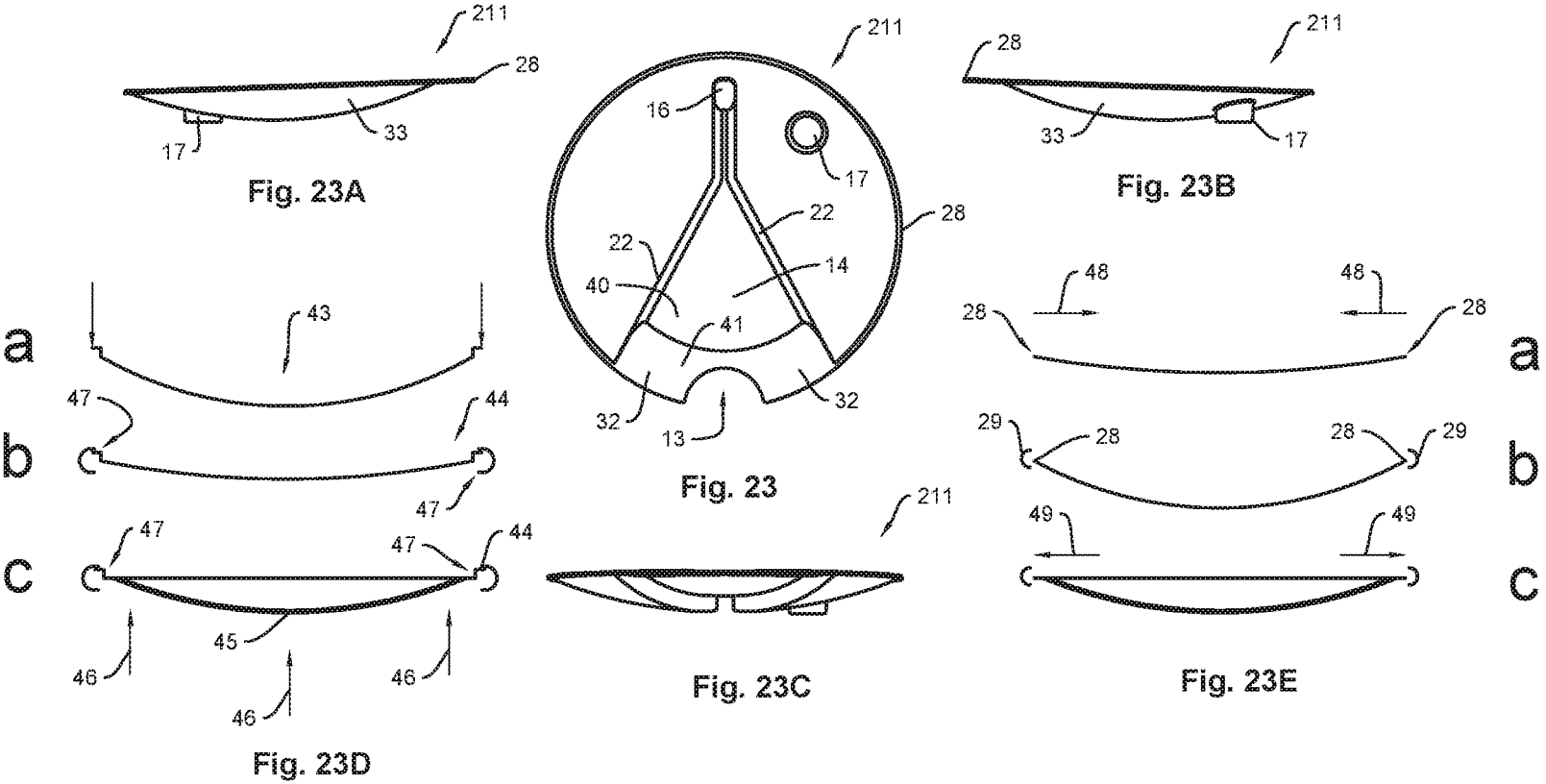

FIG. 23 is a top plan view of the upper lid construction of the second alternative lid assembly according to the present invention.

FIG. 23A is a left lateral edge view of a second alternative upper lid construction according to the present invention.

FIG. 23B is a right lateral edge view of the second alternative upper lid construction according to the present invention.

FIG. 23C is an anterior edge view of the second alternative upper lid construction according to the present invention.

FIG. 23D is a three-part schematic depiction of (a) an upper lid construction being directed downwardly; (b) an edge-supporting structure of a lower lid construction; and (c) the upper lid construction being coupled to the edge-supporting structure of the lower lid construction and showing depicting upwardly directed forces, the downwardly bowed shape of the upper lid construction for counteracting against the upwardly directed forces.

FIG. 23E is a three-part schematic depiction of (a) a resilient upper lid construction being actuated inwardly; (b) an actuated upper lid construction being received in an edge-receiving groove; and (c) the actuated upper lid construction resiliently directing forces outwardly into the edge-receiving groove.

Figure 24B:
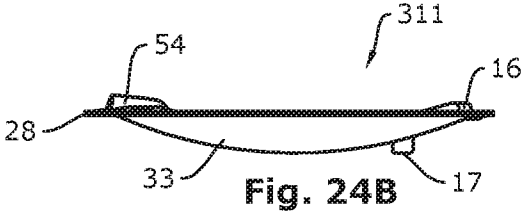
Figure 24:
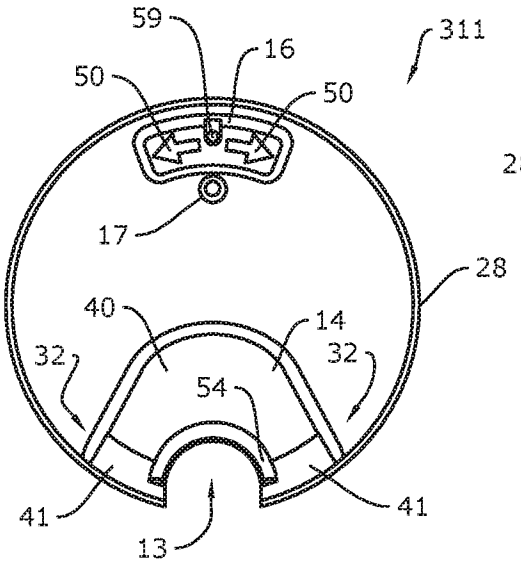

FIG. 24 is a top plan view of a third alternative upper lid construction according to the present invention.

Figure 24C:
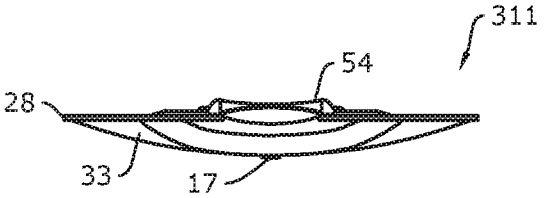
Figure 24A:
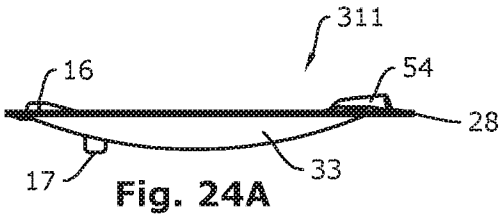

FIG. 24A is a left lateral edge view of the third alternative upper lid construction according to the present invention.

FIG. 24B is a right lateral edge view of the third alternative upper lid construction according to the present invention.

FIG. 24C is an anterior edge view of the third alternative upper lid construction according to the present invention.

Figure 25B:
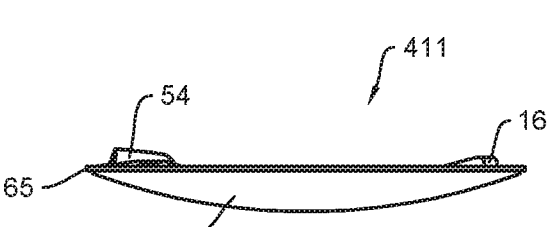
Figure 25D:
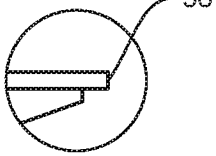
Figure 25:
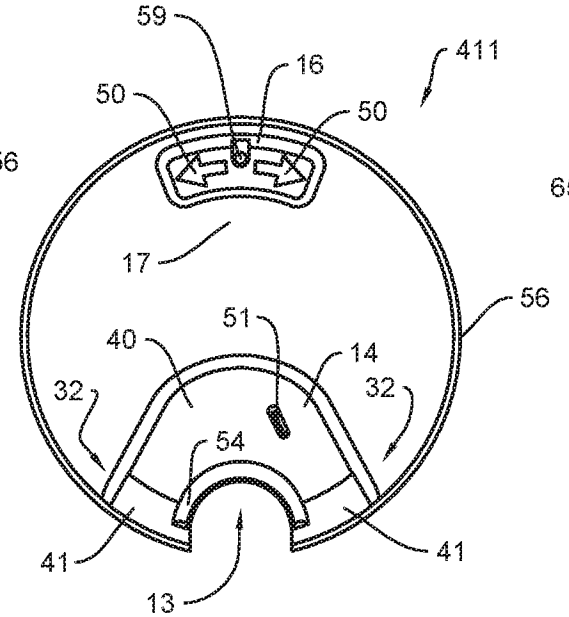

FIG. 25 is a top plan view of a fourth alternative upper lid construction according to the present invention.

Figure 25C:
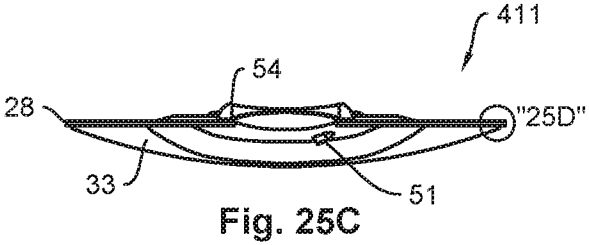
Figure 25A:
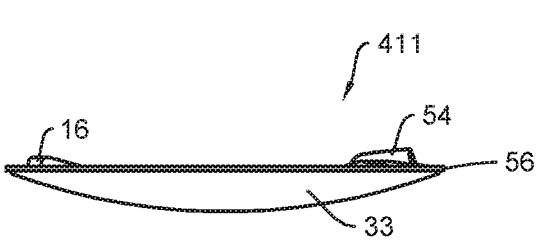

FIG. 25A is a left lateral edge view of the fourth alternative upper lid construction according to the present invention.

FIG. 25B is a right lateral edge view of the fourth alternative upper lid construction according to the present invention.

FIG. 25C is an anterior edge view of the fourth alternative upper lid construction according to the present invention showing a downwardly extending or protruding nub formed on the underside of the fourth alternative upper lid construction.

FIG. 25D is an enlarged fragmentary sectional view as enlarged and sectioned from FIG. 25C to show in greater detail a stepped peripheral outer edge of the fourth alternative upper lid construction according to the present invention.

Figure 26A:
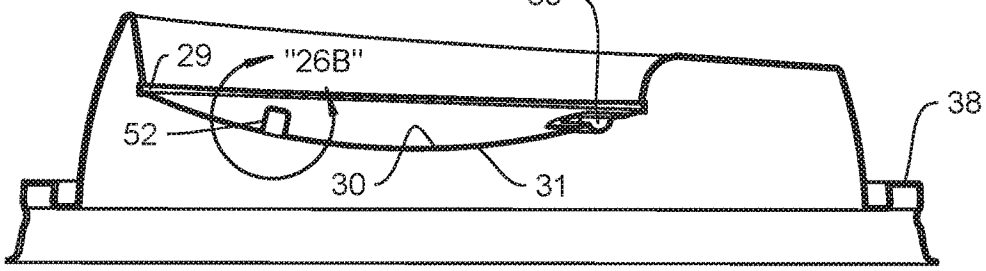
Figure 26B:
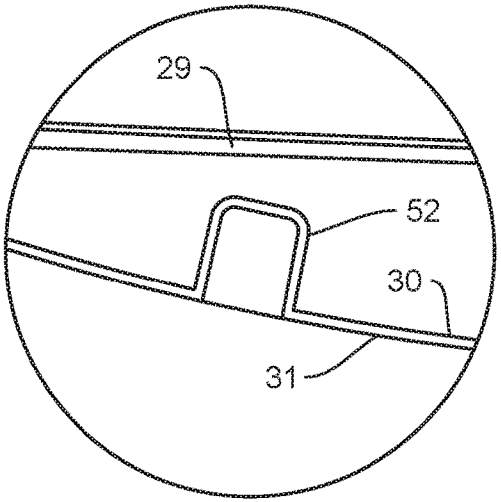
Figure 26:
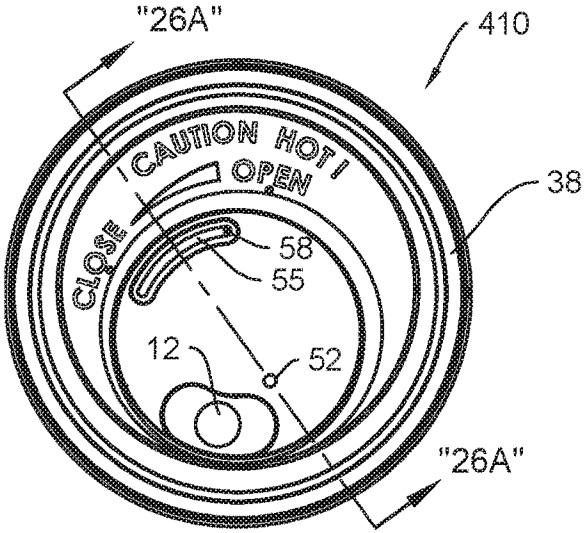

FIG. 26 is a top plan view of a second alternative lower lid construction according to the present invention.

FIG. 26A is a vertical cross-sectional depiction of the second alternative lower lid construction according to the present invention as sectioned from FIG. 26.

FIG. 26B is an enlarged fragmentary sectional view as enlarged and sectioned from FIG. 26A to show in greater detail an upwardly extending stopper element formed in the offset depression for engaging the downwardly extending or protruding nub otherwise depicted in FIG. 25C.

Figure 26C:
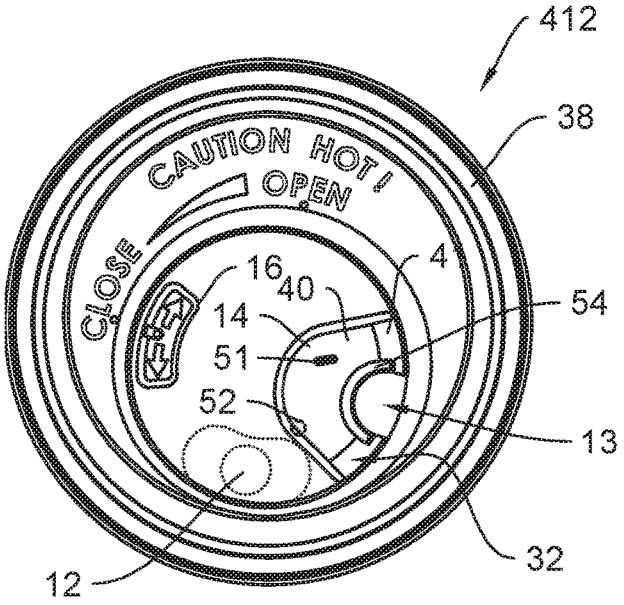

FIG. 26C is a first sequential top plan view depiction of the fourth alternative lid assembly according to the present invention in a fully closed configuration.

Figure 26F:
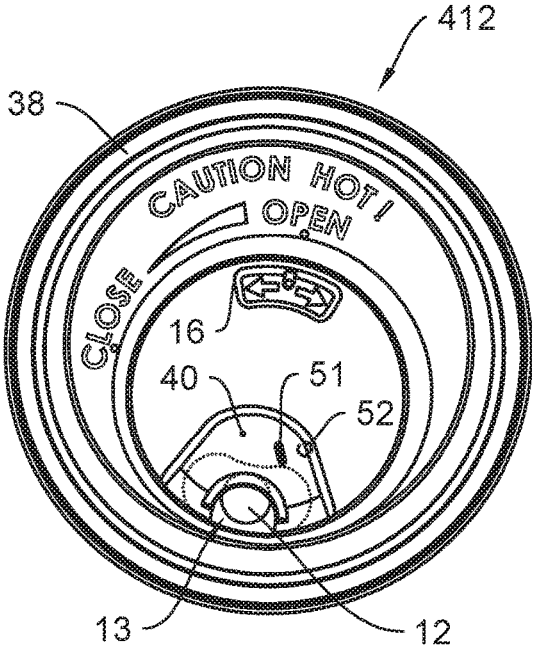
Figure 26D:
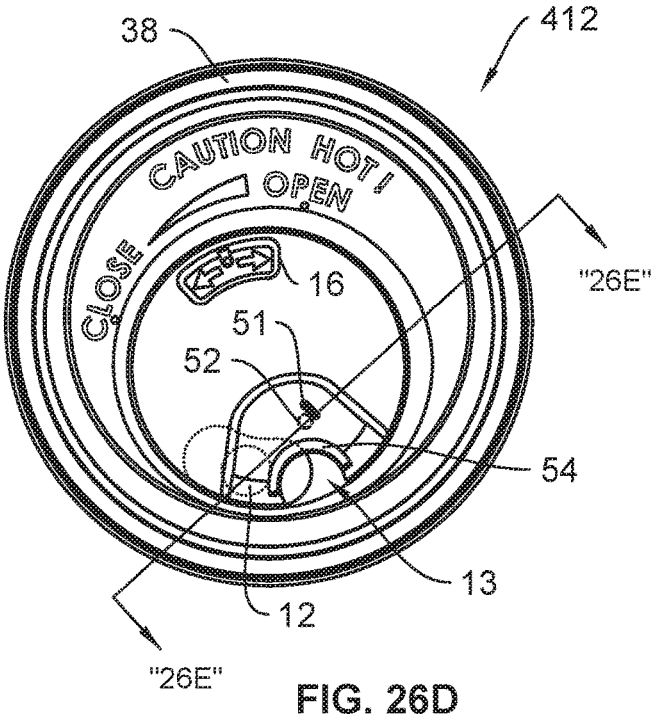

FIG. 26D is a second sequential top plan view depiction of the fourth alternative lid assembly according to the present invention in a first partially open configuration.

Figure 26E:
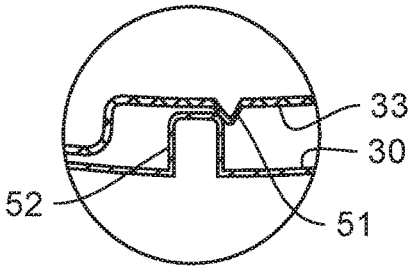

FIG. 26E is an enlarged fragmentary cross-sectional view as enlarged and sectioned from FIG. 26D to show in greater detail the structural relationship between the protruding nub of the fourth alternative upper lid construction and the stopper element of the fourth alternative lower lid construction.

FIG. 26F is a third sequential top plan view depiction of the fourth alternative lid assembly according to the present invention in a fully open configuration.

DETAILED DESCRIPTION OF THE PREFERRED EMBODIMENTS

Referring now to the drawings with more specificity, FIGS. 1-1C depict a series of images that attempt to depict a user 109 drinking from a liquid container 108 outfitted with a first alternative lid assembly with nested bowl or insert feature according to the present invention with the first alternative lid assembly 100 shown in a fully open position or configuration. The fully open position is perhaps best shown or depicted in FIG. 1A. Outletting liquid 110 is depicted in FIG. 1B. The liquid volume as at 110 being outlet is diagrammatically or schematically depicted in FIG. 1C with three relatively large drops (as compared to drop sizes shown in FIGS. 2C and 3C) in an attempt to denote a maximum flow rate of the beverage or liquid when a lower aperture 12 (i.e. a first liquid-letting aperture) formed in the lower lid construction 10 is in alignment with an upper aperture or primary liquid-letting outlet 13 formed in the upper lid construction 11.

The series of images presented in FIGS. 1-1C are intended to be visually compared to the series of images presented in FIGS. 2-2D and 3-3C. The first alternative lid assembly 100 preferably comprises a lower lid construction as at 10 and an upper lid construction as at 11, which upper lid construction 11 is received by or seatable within the lower lid construction 10. In this regard, the lower lid construction 10 preferably comprises an axially offset depression 31 that is horizontally circular and vertically continuously arcuate through most of the 360 degrees around the horizontally circular formation. The vertical depression axis 106 of the offset depression 31 is parallel to the primary lower lid construction axis 107 of the horizontally circular lower lid construction 10. The lower lid construction 10 does preferably comprise a lower aperture 12 and a knob-receiving/guiding arcuate groove formation as at 18. The upper lid construction 11 preferably comprises an upper or primary liquid-letting aperture as at 13. Referencing FIG. 1A, the reader will note that the lower and upper apertures 11 and 12 are aligned when in the fully open position for enabling the maximum liquid egress rate as at 110.

The series of images set forth in FIGS. 2-2D represent a second set of images that attempt to a user 109 drinking from a liquid container 108 outfitted with the first alternative lid assembly 100 according to the present invention with the first alternative lid assembly 100 shown in a first partially open/full sip position or configuration. The first partially open/full sip position or configuration is perhaps best shown or depicted in FIG. 2A. Outletting liquid as at 111 is depicted in FIG. 2B. The liquid volume 111 being outlet is diagrammatically or schematically depicted in FIG. 2C with three relatively medium sized drops (as compared to drop sizes shown in FIGS. 1C and 3C) that are relatively more "pulverized" as compared to the drop sizes in FIG. 1C in an attempt to denote a flow rate of beverage or liquid 111 less than the maximum flow rate 110 when the first alternative lid assembly is in the first partially open configuration. Another benefit of diverted flow is the prevention of spills particularly when the drinker is in motion as when walking or driving a vehicle.

Specifically when a drinker 109 exercises more restricted liquid flow options, the drinker will typically suck a relatively small (possibly very hot) amount of liquid 126. Because a small amount of liquid passes through air chamber 23 between inletting opening 12 of the bowl shape depression 31 and outletting opening 13 of the disk or upper lid construction 10, rapid expansion of the small amount of liquid in this air chamber 23 creates "pulverization" effect (i.e. small amount of liquid extensively and turbulently mixes with rapidly moving air flow) thereby dispersing and cooling liquid, effectively creating a liquid mist. This utility is applicable and useful not only to hot beverage containers as at 108, but to baby bottles also. Usually baby bottles made with nipple-like devise, where liquid is sucked out from container. To prevent "choking" effect of liquid flow that happens too often with these kinds of bottles, liquid pulverization effect lessens likelihood of choking by liquid flow.

It will be recalled that the first alternative lid assembly 100 comprises a lower lid construction 10 and an upper lid construction 11, and that the lower lid construction 10 comprises a lower aperture 12 and that the upper lid construction 11 comprises an upper aperture 13. The lower and upper apertures 11 and 12 are offset in the first partially open/full sip position. In this regard, the lower aperture is structurally situated in lateral adjacency the upper aperture 13 when considered from a plan view but underlying an overlying lateral stem portion 32 of the raised triangular formation 14 of which there are two portions 32 that flank the upper aperture 13. Outletting liquid 126 collides with or is otherwise diverted to the upper aperture 13 via the lateral stem portion 32 that overlies the lower aperture 12 slowing the delivery of liquid flow enabling heat transfer and reducing the flow rate to flow 111. Lower aperture is fully open and the lateral stem portion 32 redirects the liquid flow egressing therethrough.

The upper lid construction 11 is preferably horizontally circular and vertically arcuate through most of the 360 degrees around the horizontally circular formation. Stated another way, the depression 31 and the upper lid construction are both bowl-shaped in vertical cross-section such that the upper lid construction 11 may nest or seat into the bowl-shaped formation of the lower lid construction 10. Peripheral edging 28 of the upper lid construction 11 is received in an edge-receiving groove 29 of the lower lid construction 10. Before being so received, and when in a relaxed state, the radius of curvature 115 of upper lid construction 11 is slightly larger than the radius of curvature 116 of the depression 31 of the lower lid construction 10. When upper lid construction 11 is nested in the lower lid construction 10, the upper lid construction 11 is actuated as at vectors 117 such that the radii of curvature 115 and 116 of upper and lower lid constructions 11 and 10 are substantially the same and space intermediate span section 15 extending from the raised triangular formation 14 to the edging 28 and upper surfacing 30 is minimized, the lower portion surfacing 33 of the upper lid construction 11 being in contact with the upper surfacing 30 at those areas underlying span sections 15.

The upper lid construction 11 further comprises a raised formation 14 topographically raised and generally parallel relative to a bowl-shaped lower lid-engaging formation as at spanning sections 15. In a preferred embodiment, the raised formation is generally triangular in shape with an upwardly extending knob 16 at the vertex opposite the upper aperture 13 intermediate the flanking stem portions 32 for aiding the user in manually rotating the upper lid construction 11 relative to the depression 31 about axis 106 intermediate the fully open and fully closed configurations denoted marking as at open marking 34 and close marking 35. The upper lid construction 11 further comprises a downwardly extending knob 17. The downwardly extending knob 17 is received in knob-receiving/guiding arcuate groove formation formed in the lower lid construction 10. The arcuate groove 18 comprises opposed relatively high resistance ends as at 19, the width or span of which ends 19 structurally engages the diameter of the knob 17 and a relatively low resistance center region as at 20, the width of which is greater than the diameter of the knob 17 for decreasing resistance as the knob 17 translates through the arc length of the groove 18. When entering the ends 19, the user can detect the change in resistance as the diameter of the knob 17 engages the structure of the ends 19.

As previously noted, and referencing FIG. 2A, the reader will there see that the lower aperture 12 is offset from the upper aperture 13, but fully extended between the edge 21 of aperture 13 and the edge 22 of triangular formation 14 underling the stem portion 32. This position allows liquid 126 to enter the compartmental space 23 defined between the raised formation 14 and the lower lid construction 10. Heat transfer 101 from the space-received liquid is relatively rapid as the relatively reduced liquid volume is diverted within said space 23 before exiting the upper aperture 13. FIG. 2D depicts offset apertures 12 and 13 with hot container-contained liquid 126 moving as at arrow 102 from the container 108 through the aperture 12 into the space 23 as at arrow 103 and diverted within the space 23 under the downwardly extending arcuate ridge formation 24 into the outlet compartment 25 in inferior adjacency to the aperture 13 as at 104 for consumption. The reader is asked to note the heat transfer 101 from space-defined liquid 25 before consumption.

The reader will also please note the horizontally arcuate downwardly or vertically extending ridge formation 24 and the upwardly extending or vertically raised ridge formation 26, which formation 26 lines or rings the lower aperture 12. When the lower aperture 12 is moved into and out of alignment with the upper aperture 13, the ridge formations 24 and 26 engage one another for preventing liquid movement through the site of engagement and diverting liquid 126 either into compartmental space 23 or toward the upper aperture 13. The ridge formation 24 thereby provides a first damming structure cooperable with a second damming structure provided by ridge formation 26.

The series of images presented in FIGS. 3-3C are a third set of images together depicting a user drinking from a liquid container 108 outfitted with the first alternative lid assembly 100 according to the present invention with the lid assembly 100 shown in a second partially open/start-sip position or configuration. The second partially open/start-sip position or configuration is perhaps best shown in FIG. 3A. Outletting liquid as at 112 is depicted in FIG. 3B. The liquid volume 112 being outlet is diagrammatically or schematically depicted in FIG. 3C with three relatively small sized drops (as compared to drop sizes shown in FIGS. 1C and 2C) that are relatively more "pulverized" as compared to the drop sizes in FIG. 2C in an attempt to denote a minimized flow rate of beverage or liquid 112 when the first alternative lid assembly is in the second partially open configuration.

Referencing FIG. 3A, the reader will there see that the lower aperture 12 is offset from the upper aperture 13, and further overlaps with edge 22 of triangular formation 14. This position allows liquid to enter the compartmental space 23 defined between the raised formation 14 via a relatively smaller aperture 12', the size of which is diminished as the edge 22 passes thereover as the upper lid construction 11 is moved or rotated toward the fully closed position. Heat transfer from the start-sip or second partially open position is extremely rapid given the relatively low liquid volume or high "pulverization" state of the liquid (as schematically depicted in FIG. 3C) in the so-called "start-sip" position.

FIG. 4 is a top plan view of the first alternative lid assembly 100 according to the present invention with the first alternative lid assembly 100 shown in a fully closed position with the lower aperture 12 shown in hidden or broken lines. FIG. 4A is a cross-sectional view of the first alternative lid assembly 100 according to the present invention with the lid assembly 100 shown in the fully closed position such that the knob 17 is received in an end 19 of the groove 18, which overlies an air hole or aperture 27 formed in the end 19 of the groove 18 for inhibiting air passage therethrough when in the fully closed position. FIG. 4B is an enlarged, fragmentary sectional view as enlarged and sectioned from FIG. 4A to highlight in greater detail the knob 17 received in the end 19 of groove 18 in superior adjacency to the air hole 27.

FIG. 4C is an enlarged, fragmentary sectional view as sectioned from FIG. 4A to highlight the junction where peripheral edging 28 of the upper lid construction 11 is received in an edge-receiving groove 29 of the lower lid construction 10. FIG. 4D is a further top plan view of the first alternative lid assembly 100 according to the present invention with the first alternative lid assembly 100 shown in the fully closed position. FIG. 4E is an enlarged cross-sectional view of the first alternative lid assembly 100 as sectioned from FIG. 4D. FIG. 4F is an enlarged, fragmentary sectional view as enlarged and sectioned from FIG. 4E to highlight the lower aperture 12 covered by bowl-shaped lower lid-engaging formation as at span section 15. FIG. 4F shows span section 15 tightly fitting over lower aperture 12 with raised peripheral edge 26 ensuring tight fit and the prevention of liquid migration through the lower aperture 12.

The figures set forth in FIGS. 5A through 5D present the first alternative lid assembly 100 according to the present invention in a fully closed position or configuration in various side by side views for ease of comparison. Similarly, the figures set forth in FIGS. 6-9 depict the first alternative lid assembly 100 according to the present invention in the second partially open position or configuration in various side by side views for ease of comparison. FIG. 10 is a longitudinally transverse cross-section through the first alternative lid assembly 100 and through the lower aperture 12 formed in the lower lid construction 10 when in the partially open configuration otherwise depicted in FIGS. 6-9. FIG. 10A is an enlarged fragmentary sectional view as enlarged and sectioned from FIG. 10 to show in greater clarity the lower aperture 12 formed in the lower lid construction 10 partially covered by a span section 15 and partially open to let liquid 126 into the compartmental space 23.

The figures set forth in FIGS. 11A through 11C present the first alternative lid assembly 100 according to the present invention in the first partially open position or configuration in various side by side views for ease of comparison. In the first partially open position of configuration the lower aperture underlies the stem portion 32 for diverting and delaying liquid 126 delivery to the upper aperture 13. FIGS. 12 and 12A depict in greater clarity the structural relationships between the upper lid construction 11 and the lower lid construction 10 when the lid assembly 100 is in the first partially open position of configuration. Notably, the lower aperture 12 is situated adjacent the arcuate ridge formation 24 in this configuration. FIGS. 13 and 13A show more clearly the direct path for liquid 126 to enter into the compartmental space 23 when the lid assembly 100 is in the first partially open position of configuration.

The figures set forth in FIGS. 14A through 14C present the first alternative lid assembly 100 according to the present invention in the fully open position or configuration in various side by side views for ease of comparison. FIG. 15 is a longitudinally transverse cross-section through the first alternative lid assembly 100 and transversely widthwise through the raised upper formation 14 of the upper lid construction 11 to draw the reader's attention to the compartmental space defined by the raised upper formation 14 of the upper lid construction 11. FIG. 15A is an enlarged fragmentary sectional view as enlarged and sectioned from FIG. 15 to show in greater clarity the space 23 and surrounding structural relationships. FIGS. 16 and 16A attempt to show in greater clarity the structural relationship between the upper lid construction 11 and lower lid construction 10 relative to the lower aperture 12 and upper aperture 13 when in the fully open configuration for enabling a maximum flow rate.

The figures set forth in FIGS. 17A-23C depict a second alternative lid assembly 200 according to the present invention with the lid assembly 200 shown in various corresponding positions, including a fully open or heavy flow (as at 110) position in FIGS. 17 and 17A; a full sip or medium flow (as at 111) first partially open position in FIGS. 18 and 18A; a start-sip or slow flow (as at 112) second partially open position in FIGS. 19 and 19A; and a fully closed no flow position in FIGS. 20 and 20A. The reader will note the changing location of the lower aperture 12 relative to both the upper aperture 13 and the edging 22 in the various positions. The upper lid construction 211 is substantially similar to the upper lid construction 11 but for the placement of the downwardly extending knob 17 and upwardly extending knob 16. The upper lid construction 211 is believed to operate according to the principles and structural descriptions set forth hereinabove in connection with upper lid construction 11 and is comparatively shown in different views in FIGS. 23-23C for ease of comparison.

The primary functions of both the first and second alternative lid assemblies are to provide the user 109 with an ability to gradually increase or decrease the rate of liquid flow from the container 108 by manually moving the leveler knob 16 intermediate fully open and closed positions or configurations with particularly designed features associated with the upper and lower lid constructions to divert and/or delay liquid 126 delivery from the container 108 to the upper aperture 13 of the upper lid constructions 11 and 211 via the lower aperture 12 of the lower lid construction 10. There may be marking positions marked upon the upper surfacing 37 of the lower lid construction such as "close" as at 35; "–½-" as at 36; and "open" as at 34. The marking "½" as at 36 means half of maximum flow for informing the user understand s/he has an option to gradually increase rate of liquid flow.

There is a tight fit between the concave upper surfacing 30 of the depression 31 and the convex lower portion surfacing 33 of portions of the upper lid constructions 11 and 211 to prevent/limit liquid 126 to pass between these surfaces. The upper lid constructions 11 and 211 may be resiliently actuated when nested into the depression 31 for further effecting a snug or tight fit between the upper and lower lid constructions 11/211 and 10. Referencing FIGS. 23D and 23E, it will be seen that the convex outer surfacing 45 of the downwardly bowed upper lid construction 43 in FIG. 23D counteracts against the upwardly directed forces 46 much like an arch counteracts a downwardly directed load, and the upwardly directed forces 46 are thus directed into the junction sites 47 for enhancing the seal between the upper lid construction 43 and the edge-supporting structure 44.

Referencing FIG. 23E, the reader will there consider FIG. 23E, a three-part schematic depiction showing (a) a resilient upper lid construction 11 being actuated inwardly as at arrows 48; (b) an actuated upper lid construction 11 being received in an edge-receiving groove 29; and (c) the actuated upper lid construction 11 resiliently directing forces 49 outwardly into the edge-receiving groove 29. The actuable upper lid construction 11 thus provides more resistance to inadvertent circular movement of the upper lid construction relative to the lower lid construction 10. Further, with an actuable upper lid construction 11 or 211, manufacturing tolerances are not as critical to achieve pressure sealing conditions between the upper portion concave surfacing 30 of the lower lid construction 10 and the lower portion convex surfacing of the upper lid constructions 11 and 211. It will thus be understood that the upper lid construction comprises a resilient material for providing an upper lid construction resilience for maintaining cooperative structural engagements in constant contact under restorative force for enhancing fitted engagement of the upper lid construction relative to the lower lid construction.

Referencing FIGS. 24-25D, the reader will there consider third and fourth alternative upper lid constructions 311 and 411, respectively. The third alternative upper lid construction 311 is substantially similar to upper lid constructions 11 and 211 but for the following differences. Firstly, the raised formation 14 is of a different overall shape as compared to the generally triangular shape of upper lid constructions 11 and 211 with a radiused portion opposite the aperture-flanking stem portions 32. Secondly the downwardly extending knob 16 is centrally located adjacent the upwardly extending knob 16 akin to its location shown in the upper lid construction 11. Thirdly, the upwardly extending knob 16 comprises direction indicators as at 50. Element 54 is a raised lip-protecting rim that extends in a semi-circular manner about the aperture 13 for shielding the upper lip during liquid consumption by the user 109.

Comparing the third and fourth alternative upper lid constructions 311 and 411, it will be seen that the fourth alternative upper lid construction 411 also comprises element 54 and a stepped outer peripheral edge 56 being receivable in the groove 29 of the lower lid construction 410. Upper lid construction 411 further preferably comprises protrusion nub 51. The downwardly extending knob 17 and the downwardly extending knob-receiving groove 18 are eliminated from the lower lid construction 410 otherwise depicted in FIGS. 26-26F. The protrusion nub 51 is formed on the underside of the upper lid construction 411 at an anterior portion thereof, and is designed to function as a resistance indicator of the middle/cool position of the upper lid construction 411 relative to the lower lid construction 410.

An upwardly extending stopper element 52 is thus formed on the front end of the lower lid construction 410. Movement of the upper lid construction 411 is limited by the stopper element 52 butting to either side of the nub 51 as generally depicted in FIGS. 26C through 26F. Comparing FIGS. 26D and 26F, it will be seen that nub 51 provides structural resistance, but not structural stoppage during operation of the fourth alternative lid assembly 412. The resilience of the upper lid construction 411 enables the nub 51 to pass over the stopper element 52 so that the upper lid construction 411 can be positioned in the fully open configuration. Lower lid construction 410 further preferably comprises an air-letting groove as at 55 for allowing pressure equalization during the fully closed position to prevent pressure build-up during a fully closed lid configuration. In this regard, air from the container 109 passes through air hole 58 formed in the lower lid construction 410 through groove 55 to air hole 59 formed on the upper lid construction 411 and pressure is equalized within and without the container 109.

Upper lid constructions 11, 211, and 311 all comprise a stopper or knob-receiving groove 18, in which is formed an air-letting hole 27 located in the bottom of stopper-engaging groove 18 is covered when the lid assemblies 100 and 200 are positioned into the fully closed position for better sealing the lid assembly and preventing air from coming inside the container 108 thus limiting the possibility of liquid spillage. The knob-receiving/guiding groove 18 preferably comprises tight fit ends 19 at each end of the groove 18. When the movement-stopping knob 17 is received in the ends 19, a relatively tighter fit is there achieved and the user can manually detect that he or she has reached the end(s) 19, and thus that the lid assemblies 100/200 are in either a fully open condition or configuration or fully closed condition or configuration. Thus, the tight ends 19 function to create some relatively more restricted/resisted movement of the upper lid constructions 11/211 relative to the lower lid construction 10.

The manual detection of this end-resistance enables the user to understand, without visually inspecting the lid assemblies 100/200 looking that s/he is approaching fully closed or fully open position. By pushing it through to the complete stop, s/he positions the upper lid constructions 11/211 or insert disks in fully closed position (no flow) or fully open position (direct flow). Intermediate or partially open conditions or positions of the upper lid construction relative to the lower lid construction are characterized by relatively less resistance as the knob 17 translates through the knob-guiding/receiving groove 18, center portions of which comprise a relatively more widely spaced groove walls as_compared to the tight ends 19.

While the above descriptions contain much specificity, this specificity should not be construed as limitations on the scope of the invention, but rather as an exemplification of the invention. In certain alternative embodiments, the basic invention may be said to essentially teach or disclose a liquid container lid assembly as at assemblies 100 or 200 for enabling controlled liquid egression from a liquid container as at 109. The lid assemblies 100 or 200 according to the present invention preferably comprise a lower lid construction as at 10 and an upper lid construction as at 11 or 211.

The lower lid construction preferably comprises a lid-to-container fastening means as exemplified by a rim-receiving groove as at 38, and an upper-receiving depression as at offset depression feature 31. The upper-receiving depression 31 comprises at least one liquid-letting aperture as at lower liquid-letting aperture 12. The lid-to-container fastening groove 38 removably fastens the lower lid construction 10 to an upper container rim of a liquid container 108. The upper-receiving depression 31 preferably comprises concave upper portion surfacing as at surfacing 30.

The upper lid constructions 11 and 211 are nestable in superior adjacency to the upper-receiving depression 31 and comprise lower-opposing portions and a primary liquid outlet as at upper aperture 13. The lower-opposing portions comprise convex lower portion surfacing as at 33. The convex lower portion surfacing 33 mimics the concave upper portion surfacing 30 for eliminating gaps therebetween. The primary liquid outlet 13 is orientable in superior adjacency the lower lid construction 10 by moving the upper lid constructions 11 or 211 relative the lower lid construction 10 for selectively outletting liquid 126 received in an assembly-outfitted container 108. The reader will thus note that the claimed embodiment, in is basic structure, may provide fully open and fully closed positions only. In this case, the raised formation 14 or upward structure of the disk would be eliminated and only spherical bowl shape disk may be engaged with the same shape of the depression formed in the lower lid construction 10 for providing a liquid tight engagement therebetween.

The lower lid construction 10 preferably comprises or provides a knob-receiving groove as at 18 and the upper lid constructions 11 and 211 preferably comprise or provide a downwardly extending knob as at 17. The downwardly extending knob 17 is translatably receivable in the knob-receiving groove 18 when the upper lid constructions 11 or 211 are nested down atop the upper-receiving depression 31. The knob-receiving groove 18 and the downwardly extending knob 17 are together cooperable for guiding movement of the upper lid constructions 11 or 211 relative to the lower lid construction 10 for enabling the user to more effectively control liquid egression from the outfitted liquid container 108.

The downwardly extending knob 17 preferably comprises a certain knob-girth or diameter and the knob-receiving groove 18 preferably comprises opposed groove ends 19 and a central section 20 intermediate the opposed groove (or tight) ends 19. At least one of the opposed groove ends 19 are structurally configured for resistively receiving the knob-girth of the knob 17 for providing haptic feedback to the user that the downwardly extending knob 17 is entering the at least one of the opposed groove ends 19. The opposed groove ends 19 and the downwardly extending knob 17 provide movement stop structure or upper lid construction stop structure associated with either the fully open lid configuration or the fully closed lid configuration. Thus, the haptic feedback informs the user of the user's fully open or fully closed lid configuration.

Although it is contemplated that at least one of the groove ends 19 be configured for resistively receiving the knob-girth for providing haptic feedback to the user that the downwardly extending knob 17 is entering either of the opposed groove ends 19 it is preferable that each of the opposed groove ends 19 are so configured for informing the user of the user's fully open or fully closed lid configuration. The groove end 19 associated with the fully closed configuration is preferably outfitted with an air-letting aperture as at 27, which air-letting aperture 27 basically functions to enhance pressure equalization and enhanced liquid egression via the lid assemblies 100 or 200 when the lid assemblies are in a select open configuration according to state of the art principles. It is believed inventive, however, to provide a downwardly extending knob 17 that covers the air-letting aperture 27 when received in the groove end 19 associated with the fully closed configuration for restricting pressure equalization and preventing liquid egression (e.g. spillage) via the lid assemblies 100 or 200.

In the first partially open lid configuration, the upper knob 16 is positioned radially adjacent the "½" mark as at 36 and the knob 17 is within the "relatively" free moving part or central section 20 of the groove 18, which is between two resistance ends 19 of the "mushroom head" or ended groove 18. By moving from the right to the left, the user 109 moves the knob 17 from a tight portion of the groove to relatively easy moving part of the groove, indicating beginning of restricted flow zone. Liquid flow is restricted by positioning main out-letting opening of the disk insert in inferior position to inletting opening of the spherical structure of depressed part of the main lid body.

In the second partially open lid configuration, the knob is adjacent the "½" mark 36, and the knob 17 is still within the "relatively" free moving part of the groove 18, which is between two resistance ends 19 of the "mushroom head" groove. Liquid flow is further restricted by positioning main out-letting opening 13 of the disk insert or upper lid construction in inferior position to inletting opening 12 of the spherical structure of depressed part 31 of the main lid body 10 and partially closing inletting opening 12 of the spherical structure. The 1st and 2nd restricted/cooling flow positions are for the illustration of possibility of gradual increase/decrease option. There may be one or more intermediate gradually restricted flow positions.

In the fully closed position, the knob 16 is moved to the left side or end 19 of the "mushroom head" groove 18, and the knob 17 meets resistance indicating the beginning of the fully closed position. By overcoming resistance of left side tight spot, user moves the knob 16 to a complete stop, and this is the fully closed position. The spherical or convex part of the disk insert or upper lid construction tightly aligns with concave or spherical structure of depressed part 31 of the main lid body 10 where inletting opening 12 is located and closes it.

The upper lid construction preferably comprises a raised formation as at 14, which raised formation and the lower portion surfacing 30 together define a liquid-receiving cavity or compartmental space as at 23 when the upper lid constructions 11 or 211 are nested atop the upper-receiving depression 31. The liquid-receiving cavity or compartmental space 23 may receive and shape a liquid volume receivable therein via the at least one liquid-letting aperture 12 before the liquid volume exits the primary liquid outlet 13. The raised formation may further preferably comprise primary liquid outlet flanking portions as at stem portions 32. A select primary liquid outlet flanking portion or stem portion 32 is positionable in superior adjacency to the at least one liquid-letting aperture 12 as at the first partially open lid configuration for receiving liquid 126 from the outfitted liquid container 108 and diverting liquid toward the primary liquid outlet 13 under the action of flanking portion diversion as generally described and shown in FIG. 2D.

The flanking portion diversion delays liquid delivery and enhances heat transfer from the liquid prior to liquid egression via the primary liquid outlet 13. The raised formation 14 may further preferably comprise upper formation surfacing as at 40, which surfacing 40 is parallel to the convex lower portion surfacing 33 and the primary liquid outlet flanking portions 32 comprise upper flank portions 41 that extend obliquely relative to the upper formation surfacing 40 for enhancing redirection of liquid toward the primary liquid outlet 13. The at least one liquid-letting aperture 12 preferably comprises a raised peripheral ridge as at 26, which raised peripheral ridge 26 has upper ridge apex surfacing as at 42 for engaging the lower portion surfacing 33 during movement of the upper lid constructions 11 or 211 relative to the lower lid construction 10 for enhancing compartmentalization of liquid within the outfitted liquid container 108. More particularly, the raised peripheral edge and the upper ridge surfacing creates extra pressure at the edge of lower aperture 12 when in the closed position as span section overlies the aperture 12. The raised edge 26 effectively biases the span section 15 upwardly and the restorative forces inherent to the resilient upper lid construction 11 press the span section 15 down against the upper ridge apex surfacing 42 for preventing migration of liquid through the aperture 12.

Similarly, the primary liquid outlet is preferably bordered by a downwardly extending ridge formation as at 24. The downwardly extending ridge formation 24 has lower ridge apex surfacing as at 53 for engaging the upper portion surfacing 30 during movement of the upper lid constructions 11 or 211 relative to the lower lid construction 10 for enhancing compartmentalization of liquid within the outfitted liquid container 108. The lid-to-container fastening groove 38 radially and uniformly extends about a primary lid axis as at axis 107, and the upper-receiving depression 31 radially and uniformly extends about a depression axis as at axis 106. The depression axis is parallel to the primary lid axis and thus the depression is preferably and centrally offset relative to the groove 38. The upper lid constructions 11 and 211 are rotatably nestable atop the lower lid construction 10 for enabling a user 109 to rotate the upper lid constructions about the axis 106 relative to the lower lid construction 10 for selectively orienting the primary lid outlet 13 in superior adjacency to the at least one liquid-letting aperture 12.

The lower lid construction 10 preferably comprises an edge-receiving groove as at 29, and the upper lid constructions 11 and 211 preferably comprises a peripheral outer edge as at 28. The peripheral outer edge 28 is preferably and rotatably received in the edge-receiving groove 29 for rotatably attaching the upper lid constructions 11 and 211 to the lower lid construction 10. The upper lid constructions 11 and 211 may be preferably constructed from or comprise a resilient material. Thus, the upper lid constructions may be actuated and nested or actuably nested atop the upper-receiving depression 31 for enhancing fitted engagement of the upper lid constructions relative to the lower lid construction via the resiliently directed return forces of the material construction of the upper lid constructions 11 or 211.

What is claimed is:

1. A liquid container lid assembly for enabling controlled liquid egression from a liquid container, the lid assembly comprising:

a lower lid construction, the lower lid construction comprising a lid-to-container fastening groove and a circular upper-receiving depression, the circular upper-receiving depression comprising at least one liquid-letting aperture, the lid-to-container fastening groove for removably fastening the lower lid construction to an upper container rim of a liquid container, the circular upper-receiving depression comprising concave upper portion surfacing; and a circular upper lid insert, the circular upper lid insert being rotatably nestable in superior adjacency within the circular upper-receiving depression and comprising a lower-opposing portion and a primary liquid outlet, the lower-opposing portion comprising convex lower portion surfacing, the convex lower portion surfacing mimicking the concave upper portion surfacing for eliminating gaps and providing a liquid tight engagement therebetween during rotational movement of the convex lower portion surfacing relative to the concave upper portion surfacing, the convex lower portion surfacing comprising an arcuate vertical transverse cross-sectional form, forces directed into the arcuate vertical transverse cross-sectional form being redirected radially outwardly for enhancing fitted engagement of the circular upper lid insert relative to the lower lid construction, the primary liquid outlet being orientable in superior adjacency to the lower lid construction for selectively outletting liquid from an assembly-outfitted liquid container.

2. The liquid container lid assembly of claim 1 wherein the lower lid construction comprises a downwardly extending knob-receiving groove and the circular upper lid insert comprises a downwardly extending knob, the downwardly extending knob being translatably receivable in the knob-receiving groove when the circular upper lid insert is nested atop the circular upper-receiving depression, the downwardly extending knob-receiving groove and the downwardly extending knob together being configured to cooperate with each other to guide movement of the circular upper lid insert relative to the lower lid construction for controlling liquid egression from the assembly-outfitted liquid container.

3. The liquid container lid assembly of claim 2 wherein the downwardly extending knob comprises a knob-girth and the downwardly extending knob-receiving groove comprises opposed groove ends and a central section intermediate the opposed groove ends, at least one of the opposed groove ends being configured for resistively receiving the knob-girth and thereby providing haptic feedback to the user that the downwardly extending knob is entering the at least one of the opposed groove ends.

4. The liquid container lid assembly of claim 3 wherein the opposed groove ends and the downwardly extending knob provide upper lid insert stop structure associated with a fully open lid configuration and a fully closed lid configuration, the haptic feedback for informing the user of the user's fully open or fully closed lid configuration.

5. The liquid container lid assembly of claim 4 wherein each of the opposed groove ends is configured for resistively receiving the knob-girth for providing haptic feedback to the user that the downwardly extending knob is entering either of the opposed groove ends and thus informing the user of the user's fully open or fully closed lid configuration.

6. The liquid container lid assembly of claim 5 wherein the groove end associated with the fully closed configuration is outfitted with an air-letting aperture, the air-letting aperture for enhancing pressure equalization and enhanced liquid egression via the liquid container lid assembly when the liquid container lid assembly is in a select open configuration, the downwardly extending knob covering the air-letting aperture when received in the groove end associated with the fully closed configuration for restricting pressure equalization and preventing liquid egression via the liquid container lid assembly.

7. The liquid container lid assembly of claim 1 wherein the circular upper lid insert comprises a raised formation, the raised formation comprising primary liquid outlet flanking portions, a select primary liquid outlet flanking portion being positionable in superior adjacency to the at least one liquid-letting aperture at a first partially open lid configuration for deflecting liquid from the assembly-outfitted liquid container and diverting liquid toward the primary liquid outlet under the action of flanking portion diversion, the flanking portion diversion for delaying liquid delivery and enhancing heat transfer from the liquid prior to liquid egression via the primary liquid outlet.

8. The liquid container lid assembly of claim 7 wherein the raised formation comprises upper formation surfacing parallel to the convex lower portion surfacing and the primary liquid outlet flanking portions comprise upper flank portions extending obliquely relative to the upper formation surfacing for enhancing redirection of liquid toward the primary liquid outlet.

9. The liquid container lid assembly of claim 1 wherein the at least one liquid-letting aperture comprises a raised peripheral ridge, the raised peripheral ridge having upper ridge apex surfacing, the upper ridge apex surfacing for engaging the convex lower portion surfacing during movement of the circular upper lid insert relative to the lower lid construction for enhancing compartmentalization of liquid within the assembly-outfitted liquid container.

10. The liquid container lid assembly of claim 1 wherein the primary liquid outlet is bordered by a downwardly extending ridge formation, the downwardly extending ridge formation having lower ridge apex surfacing, the lower ridge apex surfacing for engaging the concave upper portion surfacing during movement of the circular upper lid insert relative to the lower lid construction for enhancing compartmentalization of liquid within the assembly-outfitted liquid container.

11. The liquid container lid assembly of claim 1 wherein the lower lid construction comprises an edge-receiving groove and the circular upper lid insert comprises a peripheral outer edge, the edge-receiving groove and the peripheral outer edge each being rectangular in cross-section, the peripheral outer edge being received in the edge-receiving groove for attaching the circular upper lid insert to the lower lid construction, the rectangular cross-section of the edge-receiving groove and the peripheral outer edge for enhancing fitted engagement between the circular upper lid insert and the lower lid construction when forces are directed into the arcuate vertical transverse cross-sectional form.

12. The liquid container lid assembly of claim 11 wherein the circular upper lid insert comprises a resilient material for providing an upper lid insert resilience, the upper lid insert resilience for maintaining cooperative structural engagements in constant contact under restorative force when rotatably nested within the circular upper-receiving depression for enhancing fitted engagement of the circular upper lid insert relative to the lower lid construction.

13. A lid assembly for enabling controlled liquid egression from a liquid container, the lid assembly comprising:

a lower lid construction, the lower lid construction comprising a circular upper-receiving depression, the circular upper-receiving depression comprising at least one liquid-letting aperture, the lower lid construction being attachable to an upper container rim of a liquid container, the circular upper-receiving depression comprising upper portion surfacing; and a circular upper lid insert, the circular upper lid insert being rotatably nestable in superior adjacency within the circular upper-receiving depression and comprising a lower-opposing portion and a primary liquid outlet, the lower-opposing portion comprising lower portion surfacing, the lower portion surfacing mimicking the upper portion surfacing for eliminating gaps and providing a liquid tight engagement therebetween during rotational movement of the lower portion surfacing relative to the upper portion surfacing, the lower portion surfacing comprising an arcuate vertical transverse cross-sectional form, forces directed into the arcuate vertical transverse cross-sectional form being redirected radially outwardly for enhancing fitted engagement of the circular upper lid insert relative to the lower lid construction, the primary liquid outlet being orientable in superior adjacency to the lower lid construction and the at least one liquid-letting aperture for selectively outletting liquid from an assembly-outfitted liquid container.

14. The liquid container lid assembly of claim 13 wherein the lower lid construction comprises a knob-receiving groove and the circular upper lid insert comprises a knob, the knob being translatably receivable in the knob-receiving groove when the circular upper lid insert is nested atop the circular upper-receiving depression, the knob-receiving groove and the knob together being cooperable for guiding movement of the circular upper lid insert relative to the lower lid construction for controlling liquid egression from the assembly-outfitted liquid container.

15. The liquid container lid assembly of claim 14 wherein the knob comprises a knob-girth and the knob-receiving groove comprises opposed groove ends and a central section intermediate the opposed groove ends, at least one of the opposed groove ends being configured for resistively receiving the knob-girth and thereby providing haptic feedback to the user when knob is entering the at least one of the opposed groove ends.

16. The liquid container lid assembly of claim 15 wherein the circular upper lid insert comprises a raised formation, the raised formation comprising primary liquid outlet flanking portions, a select primary liquid outlet flanking portion being positionable in superior adjacency to the at least one liquid-letting aperture at a first partially open lid configuration for deflecting liquid from the assembly-outfitted liquid container and diverting liquid toward the primary liquid outlet under the action of flanking portion diversion, the flanking portion diversion for delaying liquid delivery and enhancing heat transfer from the liquid prior to liquid egression via the primary liquid outlet.

17. The liquid container lid assembly of claim 13 wherein the at least one liquid-letting aperture comprises a raised peripheral ridge, the raised peripheral ridge having upper ridge apex surfacing, the upper ridge apex surfacing for engaging the lower portion surfacing during movement of the circular upper lid insert relative to the lower lid construction for enhancing compartmentalization of liquid within the assembly-outfitted liquid container.

18. The liquid container lid assembly of claim 13 wherein the primary liquid outlet is bordered by a downwardly extending ridge formation, the downwardly extending ridge formation having lower ridge apex surfacing, the lower ridge apex surfacing for engaging the upper portion surfacing during movement of the circular upper lid insert relative to the lower lid construction for enhancing compartmentalization of liquid within the assembly-outfitted liquid container.

19. The liquid container lid assembly of claim 13 the circular upper lid insert comprises a resilient material for providing an upper lid insert resilience, the circular upper lid insert resilience for maintaining cooperative structural engagements in constant contact under restorative force when rotatably nested within the circular upper-receiving depression for enhancing fitted engagement of the circular upper lid insert relative to the lower lid construction.

20. A lid assembly for enabling controlled liquid egression from a liquid container, the lid assembly comprising:

a lower lid construction, the lower lid construction comprising a circular, concave upper-receiving depression, the circular, concave upper-receiving depression comprising at least one liquid-letting aperture; and a circular upper lid insert, the upper lid insert being rotatably nestable in superior adjacency within the upper-receiving depression and comprising a convex lower-opposing portion and a primary liquid outlet, the convex lower-opposing portion mimicking the circular, concave upper-receiving depression for eliminating gaps and providing a liquid tight engagement therebetween during rotational movement of the convex lower-opposing portion relative to the circular, concave upper-receiving depression, the convex lower-opposing portion comprising an arcuate vertical transverse cross-sectional form, forces directed into the arcuate vertical transverse cross-sectional form being redirected radially outwardly for enhancing fitted engagement of the circular upper lid insert relative to the lower lid construction, the primary liquid outlet being orientable in superior adjacency to the lower lid construction for selectively outletting liquid from an assembly-outfitted liquid container.

* * * * *